US005490077A

United States Patent [19]

Freytag

[11] Patent Number: 5,490,077

[45] Date of Patent: Feb. 6, 1996

[54] METHOD FOR DATA INPUT INTO A POSTAGE METER MACHINE, ARRANGEMENT FOR FRANKING POSTAL MATTER AND FOR PRODUCING AN ADVERT MARK RESPECTIVELY ALLOCATED TO A COST ALLOCATION ACCOUNT

[75] Inventor: Claus Freytag, Berlin, Germany

[73] Assignee: Francotyp-Postalia GmbH, Berlin, Germany

[21] Appl. No.: 181,408

[22] Filed: Jan. 13, 1994

[30] Foreign Application Priority Data

Jan. 20, 1993 [DE] Germany ..... 43 02 097.6
Apr. 16, 1993 [DE] Germany ..... 43 12 894.7

[51] Int. Cl.[6] ..... G07B 17/00

[52] U.S. Cl. ..... 364/464.02; 235/375; 235/380; 235/381

[58] Field of Search ..... 235/375, 380, 235/381; 364/464.02

[56] References Cited

U.S. PATENT DOCUMENTS

| | | | |
|---|---|---|---|
| 3,635,297 | 1/1972 | Salava | 177/177 |
| 4,122,532 | 10/1978 | Dlugos et al. | 364/900 |
| 4,138,735 | 2/1979 | Allocca et al. | 364/900 |
| 4,506,330 | 3/1985 | Dlugos | 364/466 |
| 4,802,218 | 1/1989 | Wright et al. | 380/380 |
| 4,812,994 | 3/1989 | Taylor et al. | 364/464.02 |
| 4,831,554 | 5/1989 | Storace et al. | 364/464.02 X |
| 4,868,757 | 9/1989 | Gil | 364/464.02 |
| 4,914,606 | 4/1990 | Vermesse | 364/464.02 X |
| 4,933,849 | 6/1990 | Connell et al. | 364/400 |
| 4,960,982 | 10/1990 | Takahira | 235/382 |
| 4,980,542 | 12/1990 | Jackson et al. | 235/375 |
| 5,111,030 | 5/1992 | Brasington et al. | 235/375 |
| 5,233,657 | 8/1993 | Günther | 380/23 |
| 5,352,875 | 10/1994 | Enomoto | 235/380 |
| 5,367,150 | 11/1994 | Kitta et al. | 235/380 |
| 5,388,248 | 2/1995 | Robinson et al. | 235/380 X |
| 5,397,883 | 3/1995 | Miyashita | 235/382 |

FOREIGN PATENT DOCUMENTS

| | | |
|---|---|---|
| 0230658 | 8/1987 | European Pat. Off. . |
| 0373971 | 6/1990 | European Pat. Off. . |
| 0405357 | 1/1991 | European Pat. Off. . |
| 3206539 | 9/1983 | Germany . |
| 3809795 | 1/1992 | Germany . |
| 4033164 | 4/1992 | Germany . |
| WO93/05482 | 3/1993 | WIPO . |

*Primary Examiner*—Edward R. Cosimano
*Attorney, Agent, or Firm*—Hill, Steadman & Simpson

[57] ABSTRACT

A method for data entry into a postage meter machine before the initiation of a selected printer function, an arrangement for franking postal matter and for producing a franking image respectively allocated to a cost allocation account include automatic modification of the most recent status of stored data contents in a postage meter machine for the setting thereof within a time window following the switch-on on the basis of a first data carrier and/or automatic entry of an accounting number for the cost allocation account of the user and/or of a printer function or the number of a printer function into a memory area of a memory of the postage meter machine on the basis of a further data carrier. The data carriers may be chip cards. Data for the chip card number, for the cost allocation account number and for the advert number are read out an the unprotected memory area or, after automatic password rendering, from the protected memory area of the chip card by the postage meter machine and are used in the postage meter machine for setting the cost allocation account and the associated advertising design.

18 Claims, 11 Drawing Sheets

| | DISP. COUNTRY A | | DISP. COUNTRY B | |
|---|---|---|---|---|
| | FIELD | FIELD | FIELD | FIELD |
| DATE | F1 F3 | F2 | F1 | F2 F3 |
| DATE | F5 | F6 | F6 F8 | F5 |

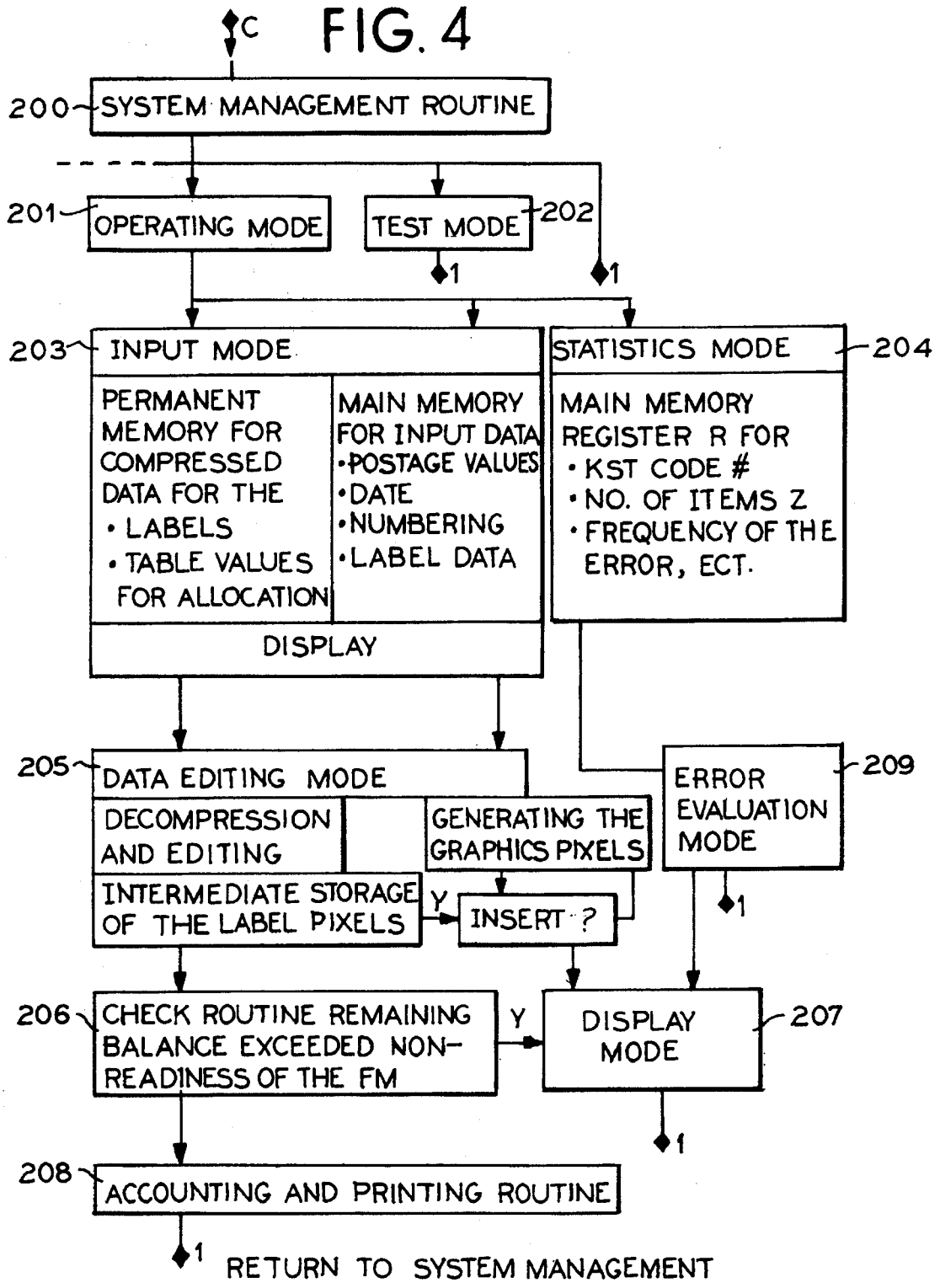
FIG. 4
C
200
SYSTEM MANAGEMENT ROUTINE
201
OPERATING MODE
TEST MODE
202
1
1
203
INPUT MODE
PERMANENT MEMORY FOR COMPRESSED DATA FOR THE
• LABELS
• TABLE VALUES FOR ALLOCATION
MAIN MEMORY FOR INPUT DATA
•POSTAGE VALUES
•DATE
•NUMBERING
•LABEL DATA
DISPLAY
STATISTICS MODE
204
MAIN MEMORY REGISTER R FOR
• KST CODE #
• NO. OF ITEMS Z
• FREQUENCY OF THE ERROR, ECT.
205
DATA EDITING MODE
DECOMPRESSION AND EDITING
GENERATING THE GRAPHICS PIXELS
INTERMEDIATE STORAGE OF THE LABEL PIXELS
Y
INSERT ?
ERROR EVALUATION MODE
209
1
206
CHECK ROUTINE REMAINING BALANCE EXCEEDED NON-READINESS OF THE FM
Y
DISPLAY MODE
207
1
208
ACCOUNTING AND PRINTING ROUTINE
1
RETURN TO SYSTEM MANAGEMENT

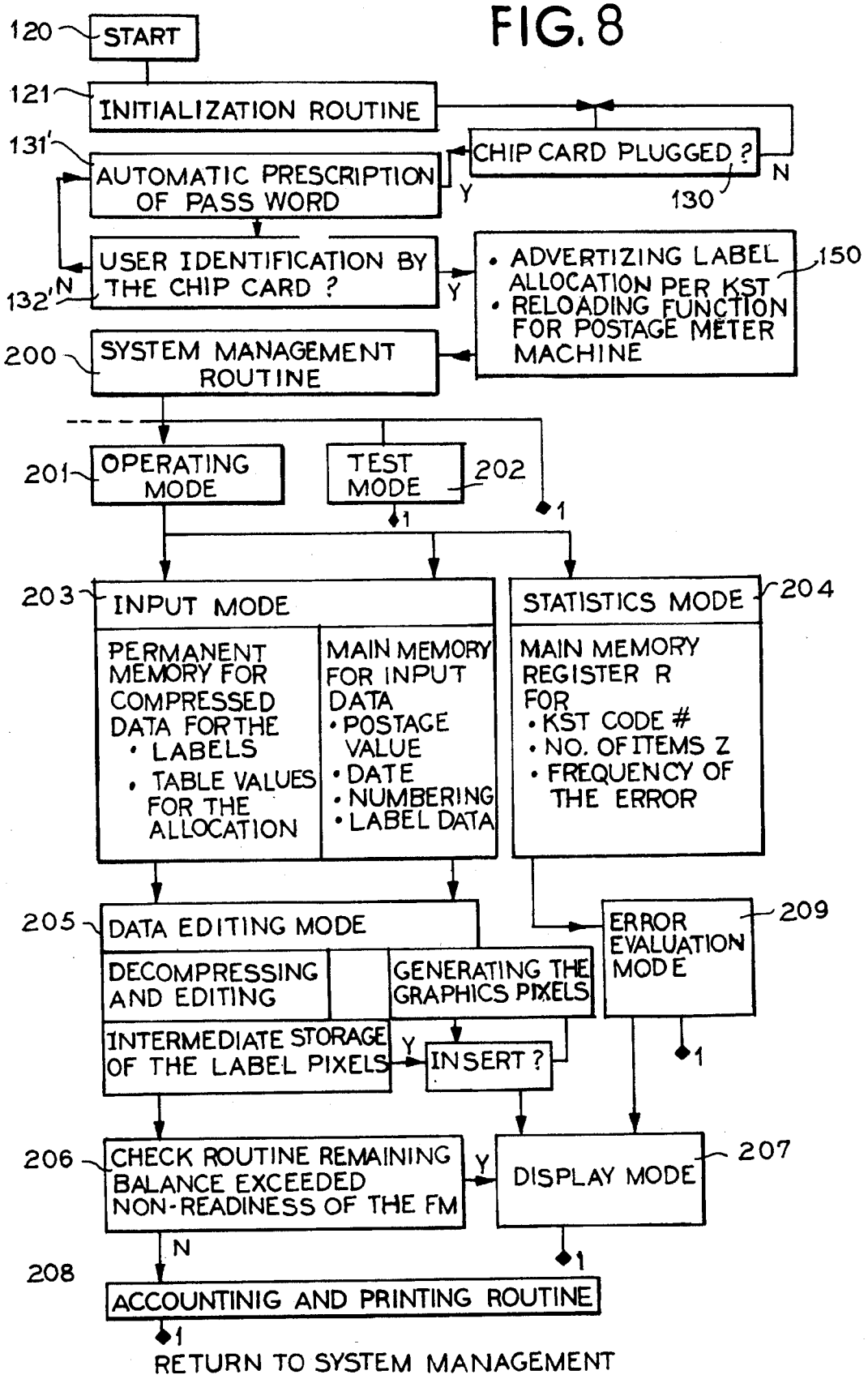
FIG. 8
120
START
121
INITIALIZATION ROUTINE
131'
AUTOMATIC PRESCRIPTION OF PASS WORD
CHIP CARD PLUGGED ?
Y
N
130
USER IDENTIFICATION BY THE CHIP CARD ?
132'
N
Y
• ADVERTIZING LABEL ALLOCATION PER KST
• RELOADING FUNCTION FOR POSTAGE METER MACHINE
150
200
SYSTEM MANAGEMENT ROUTINE
201
OPERATING MODE
TEST MODE
202
1
1
203
INPUT MODE
PERMANENT MEMORY FOR COMPRESSED DATA FORTHE
• LABELS
• TABLE VALUES FOR THE ALLOCATION
MAIN MEMORY FOR INPUT DATA
• POSTAGE VALUE
• DATE
• NUMBERING
• LABEL DATA
STATISTICS MODE
204
MAIN MEMORY REGISTER R FOR
• KST CODE #
• NO. OF ITEMS Z
• FREQUENCY OF THE ERROR
205
DATA EDITING MODE
DECOMPRESSING AND EDITING
GENERATING THE GRAPHICS PIXELS
INTERMEDIATE STORAGE OF THE LABEL PIXELS
Y
INSERT ?
ERROR EVALUATION MODE
209
1
206
CHECK ROUTINE REMAINING BALANCE EXCEEDED NON-READINESS OF THE FM
Y
DISPLAY MODE
207
N
1
208
ACCOUNTINIG AND PRINTING ROUTINE
1
RETURN TO SYSTEM MANAGEMENT

| | AREA A DISPATCHING COUNTRY | | | | | |
|---|---|---|---|---|---|---|
| | UPDATING DATUM | | | UPDATING DATUM | | |
| WEIGHT IN [g] | 1.TYPE AND FORM | 2.TYPE AND FORM | 3.TYPE AND FORM | 1.TYPE AND FORM | 2.TYPE AND FORM | 3.TYPE AND FORM |
| | | | | | | |
| | | | | | | |
| | | | | | | |
| | | | | | | |

FIG. 12

| | DISP. COUNTRY A | | DISP. COUNTRY B | |
|---|---|---|---|---|
| | TIME OF DAY FROM TO | TIME OF DAY FROM TO | TIME OF DAY FROM TO | TIME OF DAY FROM TO |
| DAILY DATE | F1 F2 | F3 F5 | F2 F4 | F1 F3 |
| DAILY DATE | | | | |
| | | | | |
| | | | | |
| | | | | |

FIG. 13

| | AREA A' | | AREA B' | |
|---|---|---|---|---|
| | FIELD | FIELD | FIELD | FIELD |
| CONDITION | | | | |
| CONDITION | | | | |

| | | |
|---|---|---|
| DATE | DISPATCHING COUNTRY | TIME OF DAY |
| | MAILING DATE<br>MAILING LOCATION<br>RECEIVING ADDRESS | |
| | ZONE | TYPE OF MAILING<br>FORM OF MAILING<br>WEIGHT |
| POSTAGE | REMAINING BALANCE | |
| FUNCTION | | |
| | LISTS<br>ADDRESSES<br>CUSTOMER NO. | TYPE OF LABEL<br>MESSAGE<br>COLOR, ETC. |
| ERROR MESSAGE | | |

METHOD FOR DATA INPUT INTO A POSTAGE METER MACHINE, ARRANGEMENT FOR FRANKING POSTAL MATTER AND FOR PRODUCING AN ADVERT MARK RESPECTIVELY ALLOCATED TO A COST ALLOCATION ACCOUNT

BACKGROUND OF THE INVENTION

1. Field of the Invention

The present invention is directed to a method for data entry into a postage meter machine, and to an apparatus for franking postal matter and for producing a franking advert mark uniquely allocated to a data center which communicates with the meter to alter the contents of accounting registers in the meter.

2. Description of the Prior Art

A postage meter machine is utilized for franking postal matter and is equipped with at least one input means, particularly with a chip card write/read unit, an input/output control means and with an output means.

Chip cards are known which comprise a plurality of non-volatile memories, or separately accessible memory areas and a microprocessor in order to transmit data representing different types of information into the postage meter machine and in order to read data out of the postage meter machine.

A postal fee accounting system disclosed in U.S. Pat. No. 5,111,030, corresponding to German OS 39 03 718 includes a write/read unit for chip cards that is connected to a postage meter machine via a control unit. Data about postage meter machine use are written into the chip card, this data being read out later with a personal computer for accounting.

German OS 40 33 164 discloses a metered postage tape system having chip card write/read unit in a common housing. Two memory areas exist in the non-volatile data memory of the chip card, the first memory area containing the current postage credit data and the second memory area containing the data for an individual advertising design (advert mark). The chip card assigned to a user can also be used in a known way for loading or recharging the postage meter machine and has a transport and accounting function for the exchange of data for fee accounting as well as a reloading function for an advertising design. The second memory area for the individual advertising design can be selected in the chip card separately from the first memory area for the postage credit and is only read when needed.

It would be desirable to additionally store accounting data (date, number and value of impressions) in the chip card in order to be able to undertake a chronologically following accounting with a personal computer. However, the storage space of this known chip card is completely occupied by the additional image data, so that no further data can be stored.

This solution is also time-consuming because, after the entry of an identification code for each user, an individual advertising design must be newly loaded from the chip card into the processor system (postage meter) via the serial interface and the old, stored, individual advertising design in the processor system must be replaced by a new, individual advertising design. The data exchange procedure via a serial interface already lasts longer than the data exchange via a parallel interface. The advertising design can thus not be constantly reloaded for every impression. This solution is thus ineffective given a constant or frequent change of users.

Due to the limited storage space that is available on a chip card, a plurality of chip cards simultaneously plugged into a plurality of write/read units would again have to be employed for further data to be entered, this further increasing the time consumed in a data read-out associated with every printing event.

U.S. Pat. No. 4,812,994 discloses a system intended to prevent unauthorized access to use the postage meter machine by inhibiting the postage meter machine given the absence of an identification signal ID and/or after the passage of a predetermined time interval without use. The ID signal can be entered by a chip card, by a personal computer, via modems or can be manually entered into the postage meter machine. The postage meter machine is enabled after a positive comparison with a user identification signal stored in the postage meter machine.

In the aforementioned solutions, the postage meter machines are inhibited for use until the chip card is plugged into a corresponding write/read unit, as a result of which the authorization of the user is initiated.

WO93/05482 corresponding to German OS 41 29 302 proposes a modified solution for incrementing the fee credit in the credit balance memory of postage meter machines on the basis of a chip card that carries a reloading credit that, when subsequently erased, can in turn be removed. In another version, the credit stored in the chip card is debited step-by-step. However, no further data can be fetched from the chip card. A pluggable EPROM is introduced into a permanently installed plug-in socket for the postal fees (postage fee table).

It is standard for service to install the new postage fee values at the customer on the basis of a non-volatile memory module. In addition to the substantial service outlay for this procedure, this may result in the use of an out-of-date postage fee table because of the necessity to replace the table in advance of its effective date, or after its effective date, since, with a large number of meters, every one cannot be installed with a new module on the same day.

U.S. Pat. No. 3,635,297 discloses a mail-handling apparatus having automatic fee value calculation. A replaceable memory (ROM) contains a postage fee table from which the amount of postage is calculated upon entry of the weight of an item to be mailed and possibly with the entry of further mailing particulars. A disadvantage of this approach is the outlay that arises when, due to a new fee schedule taking effect, the fee values must be modified in the table of the memory. It is not assured that the user of the apparatus will have the replacement of the memory for updating undertaken in time.

When a new schedule of fees takes effect, U.S. Pat. No. 4,122,532, corresponding to German OS 28 03 982 proposes a remote valuation for updating the postage fee table stored in postage meter machines. Under remote actuation, the new fee schedule is simultaneously transmitted to a plurality of postage meter machines from a central data station. Such an updating with the new fee schedule, however, assumes that the postage meter machines are turned on at these points in time and can be constantly addressed.

For protection against fraudulent manipulations, U.S. Pat. No. 4,933,849, corresponding to German OS 38 23 719 discloses that a representative character pattern be printed out beginning with a specific date. When examining the mail, the printed date and the character are compared in the Post Office to the pattern that is authorized for this date. An authorization means which comprises a memory means for storing data representing a plurality of character patterns and dates serves the purpose of printing. The data that allocate the representative character pattern to a defined date are updated via a remote valuation with an external selection means when the users of the postage meter machines request a recharging. This security system, however, is restricted to point-to-point networks and cannot be applied to portable postage meter machines that are carried from one location to another (mobile office).

It has thus not been previously possible to update portable postage meter machines, i.e. postage meter machines that are not permanently installed via a telephone network and to secure these against fraudulent manipulations.

U.S. Pat. No. 4,508,330 discloses a removable printed circuit board having DIP switches at the address input of a PROM for the selective addressing of a memory sector. Mail differences within special service classes can be economically calculated. Although the storage space for the customer data storage of postal zone tables is thereby significantly reduced, the DIP switches must be manually set.

By contrast, the postage meter machine disclosed in U.S. Pat. No. 4,138,735 comprises a rate PROM that can be equipped with a current postal fee table by radio or telephone. The possibility of a non-simultaneous transmission of a postage fee table is achieved on the basis of an individual addressing of each postage meter machine. However, it is complicated to assure that the contacting on the part of the central data center was successful. Another disadvantage is that it is unavoidable that the memories of the postage meter machine are filled with many unnecessary data.

As much data as would be desirable can definitely not be currently stored in a single chip card. Given an increased data processing outlay, however, it would be possible to reduce the total data to a "necessary" data set and to store only the necessary data set in a chip card.

Another way of bypassing the limited storage capacity present on a chip card would be to employ a plurality of chip cards simultaneously plugged into write/read units.

U.S. Pat. No. 4,802,218 discloses an automatic transmission system having a plurality of slots for chip cards that, in addition to employing a chip card for recharging credits and for accounting, whereby the postage fee value to be printed is subtracted from the credit, also simultaneously employs a further chip card for a postage fee table with whose assistance the aforementioned postage fee value is calculated. As a result of the plurality of write/read units, however, the apparatus becomes too large and too expensive.

On the other hand, accounting (debiting) data are already stored in the postage meter machine, but heretofore must additionally be stored in a chip card in order to transport the accounting data to a personal computer equipped with a chip card reader and to print out an accounting log via a printer connected thereto. However, variable printing formats can be produced with an electronic printer in postage meter machines.

It is disclosed in pending German Patent Application P 42 24 955.4 also to realize the printing of lists, for example internal accounting reports about the use of the credit stored in the postage meter machine from the individual cost allocation accounts (a customer may have a plurality of cost allocation accounts), on the basis of electronic printing processes, for example on the basis of a thermal transfer printing process. With these enhanced possibilities, however, the operation of the postage meter machine via the keyboard can easily become so complicated that an unqualified user cannot not undertake it.

Conventional automatic franking machines have input possibilities in order to set values or prescriptions or in order to input commands. Many keys are either used or few keys must be multiply occupied and be sequentially actuated.

In a known postage meter machine commercially available from Francotyp Postalia GmbH, a number is allocated to every advertising design electronically stored in the machine. After the selected number has been fetched by pressing a key, a function key for the function of setting the advert mark is actuated in order to modify the advertising design in accord with the selected number.

Since it is preferable that the outlay for the operating elements should not increase, an inexpensive, faster possibility of operation is required given a simple user interface. a non-authorized user of the postage meter machine should be prevented from fetching the data of other cost allocation accounts merely by pressing a button.

SUMMARY OF THE INVENTION

An object of the present invention is to permit the setting of a postage meter machine to be undertaken in an uncomplicated way for a plurality of users.

A further object is to provide for data entry and for supplying postage meter machines with an arbitrary amount of current data given low cost, employing chip cards for a postage meter machine having an electronic printer means.

A further object is to provide a suitable interface for the plurality of further users by means of which the use of the postage meter machine can be replicably registered, and which prevents a user whose is not authorized from reading out the data of the other cost allocation accounts.

A further object is to provide for the setting of a advertising design at a postage meter machine for a plurality of users in an uncomplicated way in order to be able to print an individual advertising design unique to a user.

The invention is based on the concept of making a set of chip cards respectively carrying different data available to the user and to use this set for a sequential setting of the postage meter machine dependent on the cost allocation accounts, via a single chip card write/read unit.

The physical possession of a chip card is comparable to providing the user with a key. Compared to acquiring an access authorization for functions of the postage meter machine without chip cards only on the basis of a password, obtaining the password surreptitiously becomes meaningless and operating errors such as, for example, forgetting to log-off after the use of the postage meter machines, are avoided with a chip card.

Proceeding on the basis of the fact that the user can employ a plurality of specific chip cards for the respectively intended thermal transfer printing function or, respectively, postage meter machine function, a method is inventively proposed wherein the chip card that loads operations that do not reduce the credit need not remain in the machine for the implementation of these operations.

The invention is also based on the consideration that the operating system of the postage meter machine—in combination with a communication and operating system of the card—is capable of gaining access to the memory of the chip card and to read its contents when one of the users of the postage meter machine inserts his or her personal chip card into the chip card write/read unit.

The assures the transmission of a new fee schedule to all postage meter machines, particularly to the portable postage meter machines that are not switched on in the meantime, or are not operational, at the correct time by causing an intermediate storage of the table in a transmission means and an automatic acceptance of the current fee schedule by the postage meter machines when they are switched on.

The invention also permits planning an early compilation of postage fee tables when there is an intent to modify a fee schedule of the postage rates, so that these can be made accessible to all postal patrons far in advance of the time they take affect. It is critical that the majority of patrons be equipped with a current postage fee table in time instead of simultaneously, as was previously the case.

A table having auxiliary functions for protection, for reviewing errors and fraudulent manipulations, and for enhancing ease of operation can be loaded when the postage meter machine is initialized or switched on.

The invention permits utilization of a personal chip card of a user for setting an advertising design that is dependent on cost allocation account. Identification of the cost allocation account and of the advertising design via the keyboard of the postage meter machine, which have heretofore been necessary, are thus advantageously eliminated.

In accordance with the invention, no advertising design is loaded from the chip card and a user-entered identification code is not a prerequisite for reading data that select the advertising design from the chip card. One advantage is that a user who has not been legitimized by the possession of a chip card no longer has any possibility at the postage meter machine of fetching data of other meters in response to pressing a button.

A further advantage of the solution of the invention is that all modules, except the scale module, can be arranged in one housing.

The postage meter machine is equipped with a non-volatile memory for a plurality of advertising designs respectively allocated to the cost allocation account of the customer and with a chip card write/read unit and enables a more frequent change of cards for a plurality of users. An existing automatic franking unit, for example a postage meter machine available from Francotyp-Postalia, can thus be equipped with a known chip card write/read unit.

The interface motherboard of the chip card write/read unit is connected to the serial interface of the postage meter machine. The contacts include at least six contacts and the data exchange between the unprotected and/or the protected card memory area and a non-volatile memory of the program memory means of the postage meter machine is automatically serially undertaken within the framework of a communication protocol as soon as the chip card has been inserted into the plug-in slot.

In a preferred embodiment, the chip card primarily serves for the customer-dependent entry of data and possibly for accounting data as well.

A further aspect of the invention is directed to a method for data entry into a postage meter machine before the initiation of a selected printing function, including the steps. The most recent status of stored data contents in a postage meter machine is automatically modified for the setting thereof when, within a time window following the turn-on, a first transmission means is offered in order to load data and/or flags effecting the modification from a memory of the transmission means into a storage area of the memory means of the postage meter machine. Alternatively or in addition, an accounting number for the cost allocation account customer user and/or a print function or the number of a print function can be automatically entered into a storage area of the memory means of the postage meter machine on the basis of further data and/or flags stored in the memory of a further transmission means, before the operation of the postage meter machine.

DESCRIPTION OF THE DRAWINGS

FIG. 4 is a flowchart for print implementation.

FIG. 8 is a flowchart for print execution in the machine of FIG. 7.

FIGS. 12 and 13 show the arrangement of auxiliary function table memory areas in a postage meter machine of the invention.

DESCRIPTION OF THE PREFERRED EMBODIMENTS

Figures 1, 6:
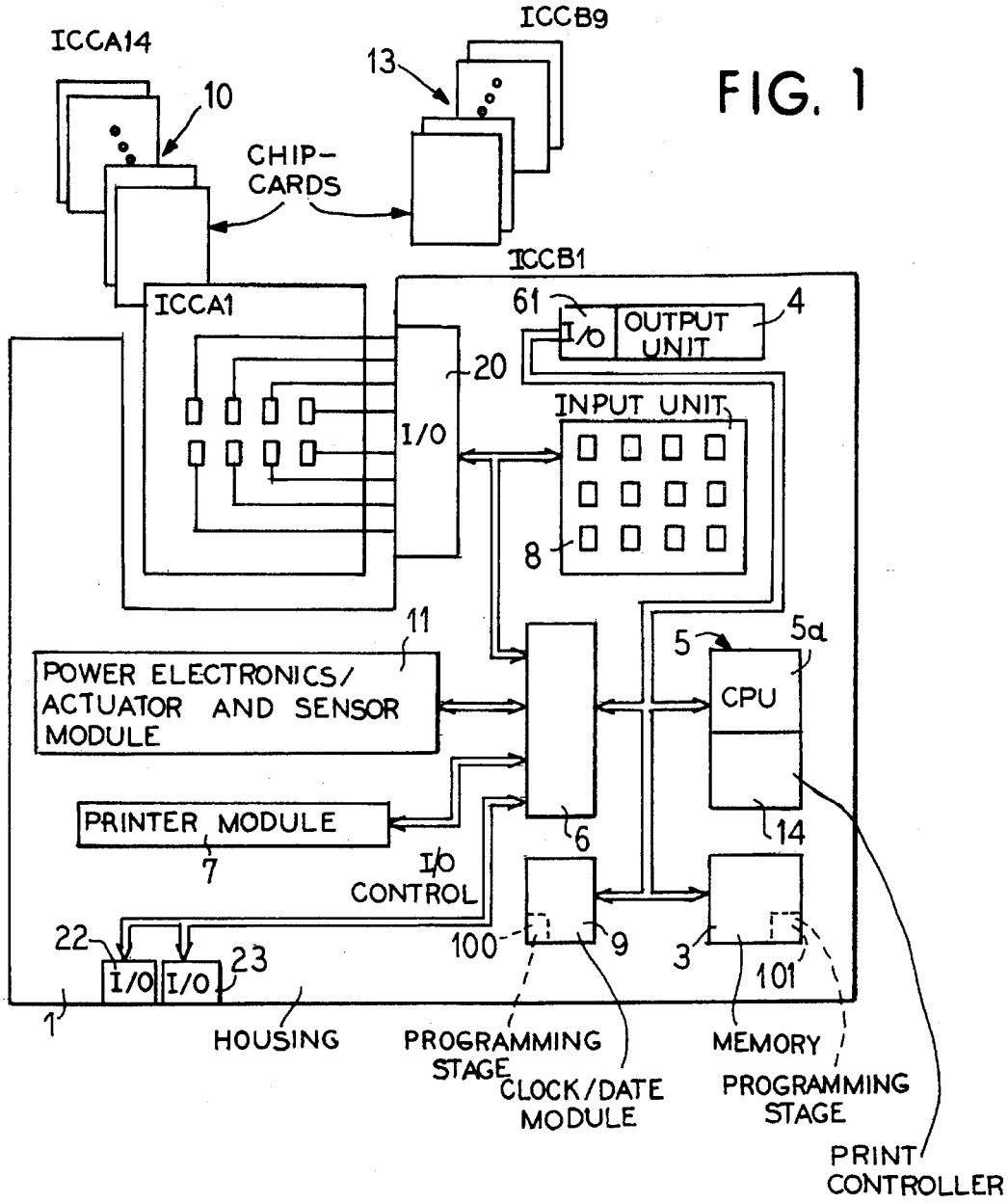
FIG. 1 is a block circuit diagram of a postage meter machine equipped with a chip card write/read unit constructed in accordance with the principles of the present invention.
FIG. 6 is the arrangement of auxiliary function table memory areas in the machine of FIG. 1.

The basic structure of a postage meter machine, for example the T 1000 franking machine currently available from Francotyp-Postalia GmbH in which the method of the invention can be implemented, shall be set forth with reference to a block circuit diagram in FIG. 1.

In a common housing 1, input unit 8 (such as a keyboard), an output unit 4 (such as a display), and I/O interfaces 20, 22 and 23 are connected via input/output control units 6 and 61 either directly or via a bus to a processor system which may be a mail-oriented protection system or a data processing system. The processor system includes at least one memory 3, one control unit 5 comprising a print controller 14 and a central processing unit **5*a*, and a clock/date module 9. The clock/date module 9 may contain a programming stage 100 such as a battery-supported memory (CMOS-RAM) and the memory 3 may contain a programming stage 101** such as a non-volatile memory (EEPROM).

The substructure of the postage meter machine includes a printer module 7 and a power electronics/actuator and sensor module 11 that contains an energy supply and control for the drives (paper transport, printer, tape, tape output). Further peripheral input/output means (not shown) can be additionally connected to the processor system. These are coupled to the processor system either directly and/or via the input/output control unit 6.

The memory 3 is composed in a standard manner of a plurality of permanent and temporary non-volatile memories. Together with the CPU 5*a*, some of the memories form a protected postal region within the processor system in a known way. A read-only memory of the memory 3 of the postage meter machine has programs for communication via interfaces 24, 22 and 23 with the external data carrier 10 or 13.

A first data carrier 10 is employed for a country-associated offering of auxiliary functions and current information for a permanent and/or temporary configuration of at least one postage meter machine, and a second data carrier 13 is employed for the user-associated setting of the postage meter machine.

In one embodiment of the invention, a communication network that contains a memory having the fetchable data and/or flags for reloading of auxiliary functions and information into the postage meter machine is utilized as the first data carrier 10.

In this embodiment, a data center transfers the data to a decentralized memory of the transmission means and the data are fetched therefrom by every postage meter machine at different points in time. The connection set-up ensues decentrally proceeding from each postage meter machine to the memory of the data carrier. The postage meter machine contains means in its control module that select from the central offering. The advantage of this solution is the elimination of calling a postage meter machine and the addressing thereof proceeding from the central data center.

An external modem that produces the connection to the memory in the communication network is connected to a predetermined interface, such as interface 23.

In a preferred embodiment, the data carriers are chip cards that are brought one at a time into contact with the interface 20, within the preferred embodiments is a chip card write/read unit.

In the embodiment shown in FIG. 1, an integrated chip card sets ICCA and ICCB are employed as the first and second data carriers 10 and 13. Each of the chip cards contains its own memory having the fetchable data and/or flags for reloading auxiliary functions and auxiliary information into the postage meter machine or for the setting thereof. The method of the invention making use of the chip cards is characterized by the following steps.

An integrated chip card ICCA set for the automatic reloading of data and/or flags is plugged into the chip card reader (I/O unit 20) within a time window following the turn-on of the machine so that the most recently stored setting of the postage meter machine can be modified. The chip card from the set ICCA is released and can be withdrawn after an indication (such as by means of the output unit 4) of the executed reloading event of data from the chip card for configuring the postage meter machine. An integrated chip card for users from the set ICCB with the customer information and the selected printing function is plugged into the I/O unit 20. A selected printing function is then initiated.

A first set of data contents a1 through a14 respectively carried by country-associated configuring chip cards ICCA1 through ICCA14 of the set ICCA, which are automatically read in dependent on existing conditions comprise:

a1 adaption of an external modem
a2 adaption of an ISDN terminal
a3 adaption of an external scale
a4 postage fee tables
a5 Post Office information, current postal zip codes
a6 current telephone number for service
a7 printing format, post form
a8 display texts for LCD
a9 deactivation of malfunctioning functions
a10 activation of unused functions
a11 setting the type font
a12 reloading soft key functions
a13 calendrical information for selecting temporary messages
a14 adaption data for daylight savings/standard time A second set of the following data contents b1 through b9 can be fetchably contained in a plurality of user chip cards ICCB1 through ICCB9 of the set ICCB.

b1 switching to the printing mode "franking", optionally with advert mark selection dependent on cost allocation accounts, with "high franking value" dependent on cost allocation accounts and with "maximum franking sum" dependent on cost centers
b2 access authorization for printing accounting reports of all cost allocation accounts and setting a predetermined format of the accounting report
b3 printing the accounting report of a selected plurality of cost allocation accounts (KST) on paper
b4 printing the accounting report of one's own KST on paper
b5 printing the accounting report of one's own KST on labels
b6 switching to the printing mode of "address printing on labels"
b7 switching to the printing mode of "printing received mail stamp"
b8 switching to the printing mode of "printing the company logo"
b9 switching to the printing mode of "printing a bar code".

The aforementioned data contents a1 through a14 can be fetchably contained either in a corresponding plurality of configuring chip cards ICCA1 through ICCAi that is equal in number to the difficult data contents or can be fetchably contained in combination with one another in a smaller plurality of configuring chip cards ICCA1 through ICCAi.

It is also provided that the data contents b1 through b9 are fetchably contained in a plurality of user chip cards ICCB1 through ICCBi equal in number to the plurality of data contents or are fetchably contained in a lower plurality of user chip cards ICCB1 through ICCBi, whereby at least some of the data contents are combined with one another stored on one chip card.

Figure 2:
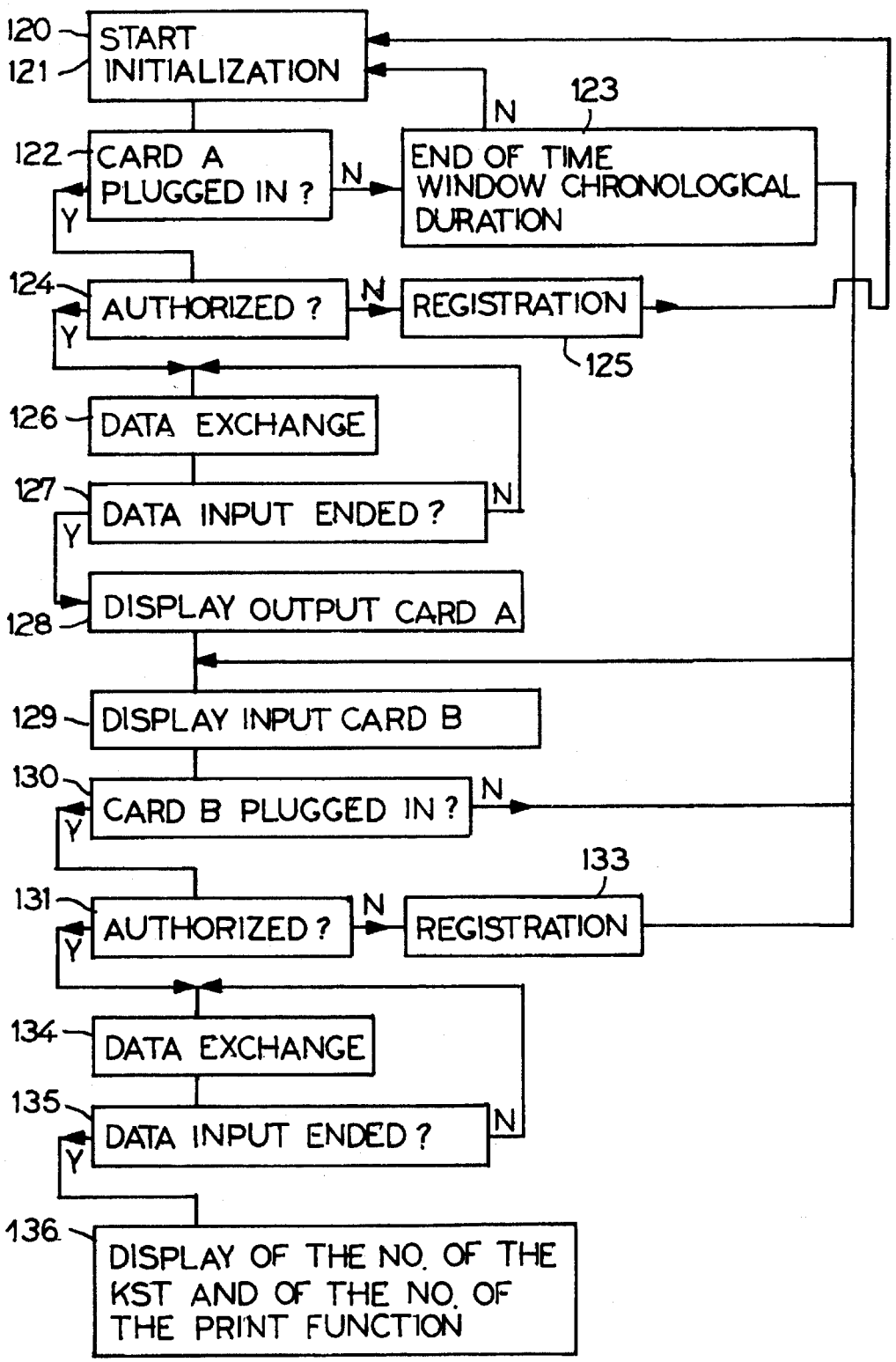
FIG. 2 is a flowchart for data entry into the machine shown in FIG. 1.

In a first version of the method illustrated by the flowchart of FIG. 2, a setting of the postage meter machine with a selected, specific user chip card B (from set ICCB) is undertaken after the machine is first configured with a selected, specific configuring chip card A (from set ICCA).

A plurality of such chip cards ICCA1 through ICCAi can be employed for specifically configuring the postage meter machine. The desired setting is undertaken with a selected, specific chip card ICCAi within a specific time window, i.e. while this is being placed in operation. "Configuring the machine" means entered all setting possibilities which influence the operation of the postage meter machine. For example, this could be setting programming stages 100 and 101 respectively for timing control and sequential control. In another version, these can be set for use as programming or memory means, i.e. specific types of control for the processing unit and/or flags whose respective causes the status activation or deactivation program routines. These collaborate with the print controller 14 and the central processing unit 5*a*.

Simultaneously with the machine functions that can be configured by such programs and/or flags, current information is also accepted into the postage meter machine. The machine functions and/or information are stored in the chip card, preferably in table form.

The manner by which data are sequentially entered into a postage meter machine using two chip cards which are successfully brought into contact with the chip card write/read unit 20 is shown in FIG. 2 in an exemplary embodiment directed to the aforementioned, first version. The setting of the postage meter machine which can thus be achieved is recited in an easily understandable form on the surface of the chip card and is displayed by the display unit (i.e., output 4) of the postage meter machine after being loaded into the postage meter machine. The configuring that is achieved is illustrated for the user in plain representation and/or with symbols before the old chip card is pulled and the next chip card is plugged into the slot.

The most recent, temporary configuration remains non-volatilely stored in the postage meter machine only until it is switched off. By contrast, the current information and permanent configurings are constantly stored until the next overwriting of data (updating) by data carriers 10 and 13, and are again available after the machine has been switched on again.

A check (not set forth in greater detail) of the postage meter machine functions and an initialization in step 121 ensues after the start (power-up) 120. A check is carried out in the following step 122 to determine whether the chip card A has been plugged in. If this has not yet ensued, a time window is begun in a step 123 and a return is then undertaken to the initialization routine 121. After the lapse of a predetermined chronological duration without a chip card A having been plugged in, a jump is made to step 129. Otherwise, a jump from step 122 to step 124 ensues, wherein the authorization is checked. In the event a chip card is recognized which is not authorized for data entry into a corresponding postage meter machine, a return back to the initialization routine 121 by the postage meter machine ensues in step 125 after a registration of the unsuccessful data entry attempt that has taken place. Given a positive check of the authorization, the predetermined data exchange ensues in step 126. A check is carried out in the following step 127 to determine whether the data input has been ended. When the data entry by the chip card A has ended, a message "card A OUTPUT" is displayed with the output unit 4 in step 128. Otherwise, if the data entry has not ended, a return back is made to step 126 in order to continue the data exchange. Following step 128—when the chip card A has been removed—, the display "INPUT CARD B" ensues in step 129 until the check in the following step 130 has shown that the chip card B has been plugged in. The authorization is then checked in step 131. When the chip card B is not plugged in, or given an unauthorized chip card B (and possibly following the registration in step 133), a return back is always undertaken to step 129 and the postage meter machine is not operational. Given an authorized chip card B that has been plugged in, a predetermined data exchange ensues in step 134. As long as it has been found in step 135 that the data entry has ended, a return back is undertaken to step 134. When the data input has ended, the input number of the cost allocation account, or the number of the input printing function is displayed in step 136. The transition to the system management routine (step 200) subsequently ensues. The steps 130, 131 and 134 are set forth in greater detail farther below—in the flowchart shown in FIG. 5.

In a first exemplary embodiment, an external scale is to be connected to the postage meter machine and a franking is to be undertaken with a franking value calculated in the postage meter machine on the basis of a weighing and with reference to a current postage fee table.

It is known to store auxiliary functions and tables, particularly a postage fee table, in a chip card (German OS 42 13 278). Such a chip card is inserted into the plug-in slot 26 (See FIG. 7) of the postage meter machine. After the unit has been switched on, the data content carried by the card a3 and a4 (for example, above) is loaded into the memory module 3 of the postage meter machine within a time window. As a reaction to the request "OUTPUT CARD A" that can read on the output unit (display) 4, the chip card ICCAi is removed. The readable request "INPUT CARD B" now appears on the output unit 4.

The user chip card ICCBj respectively containing one of the aforementioned data contents b1 through b9 is selected by the user and is introduced into the slot of the postage meter machine so that the printer of the postage meter machine carries out the desired printing function.

In accordance with the invention, only this one specific user chip card, which is plugged in last, can remain constantly plugged in for the execution of printing functions. Additionally, the cost allocation account number may be entered into the postage meter machine with a user-associated chip card.

The cost allocation account number is required for the accounting or debiting and, in particular, for the selection of the advertising design given the print function of "franking".

The user-relevant settings of the cost allocation account and of the advertising design via the keyboard of the postage meter machine which are otherwise required are thus advantageously eliminated.

In a second exemplary embodiment, an external modem is to be connected to the interface 23 of the postage meter machine in order to have the remote valuation of a credit undertaken automatically in the future.

A specific configuring chip card, such as ICCA1, is plugged into the write/read unit and the postage meter machine is switched on. As a result, an automatic reloading with data for the adaption of the postage meter machine is undertaken and the most recently set cost allocation account number (KST number) is erased. The postage meter machine can now be set to a corresponding print function of "franking".

A specific user chip card, for example ICCB1, is plugged in for reloading the cost allocation account number (KST number) and can be in turn pulled when the display of the cost allocation account number (KST number) and the number of the selected print function has ensued.

Figure 3:
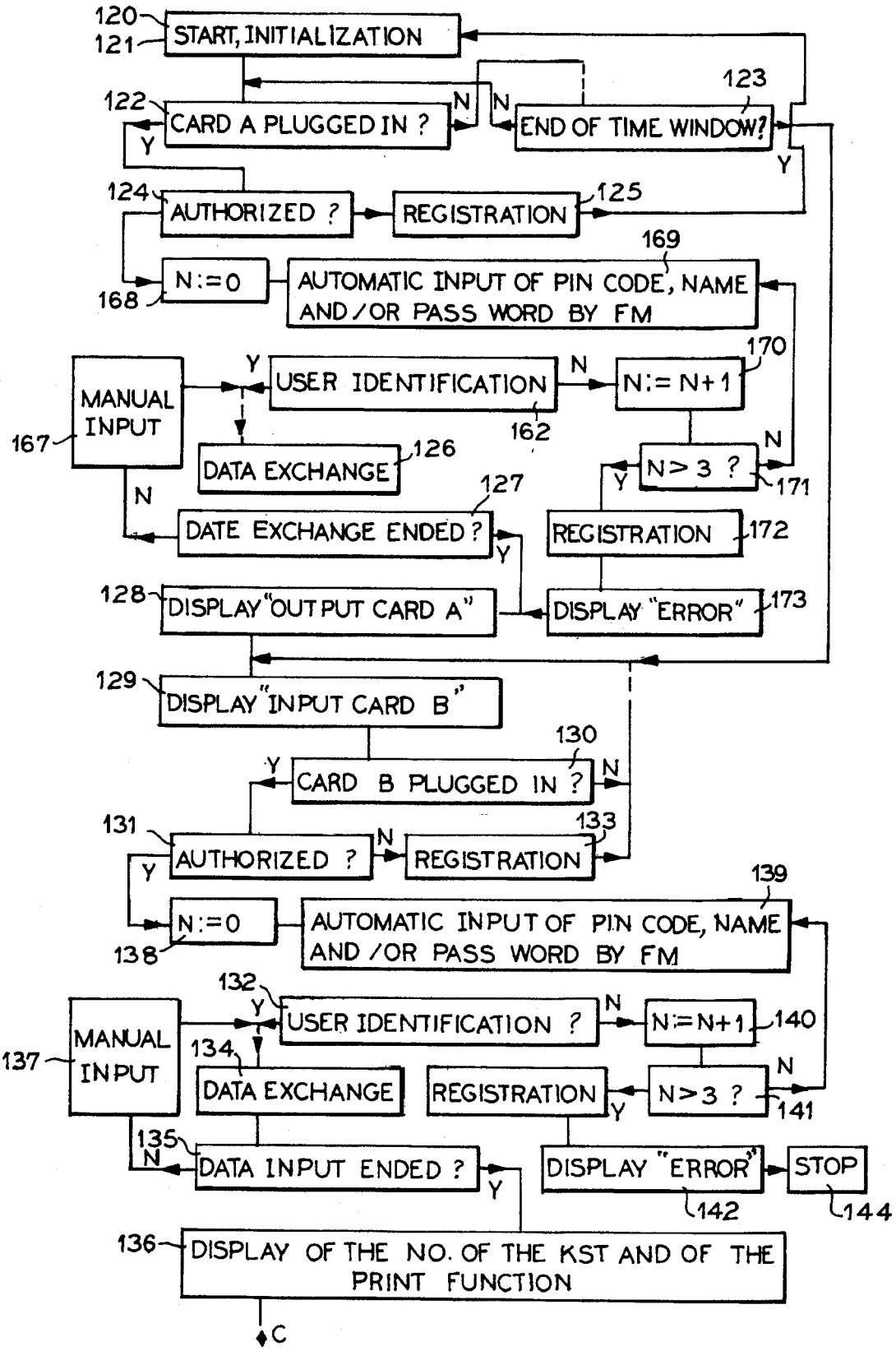
FIG. 3 is a flowchart for data entry with user identification.

In a further version shown in FIG. 3, only one user chip card ICCB1 is employed per user. Automatic and manual entries of password, PIN code or name additionally ensue for fetching the second data contents corresponding to b2 through b9.

In addition to the flowchart shown in FIG. 3, the steps 124 or 131 and the steps 126, 128 or 134 from FIG. 2 can be inserted in steps 168 through 173, or in steps 138 through 144. The steps in FIG. 2 which are also present in FIG. 3 are provided with the same reference numeral as used in FIG. 2.

In the embodiment shown in FIG. 3, after the start 120 and initialization 121 steps, a check is made in step 122 to determine whether card A has been plugged in. If the answer is "yes" a check is made in step 124 as to whether the inserted card is authorized. If the answer in step 122 was "no" a check is made in step 123 as to whether the end of the chronological duration of the time window has been reached within which a card can be inserted. If not, the sequence loops through steps 122 and 123 until either card A is inserted, or the end of the time window is reached. If the end of the time window is reached, a jump is made to step 129, for the instruction to insert card B (discussed below).

If it is determined in step 124 that the inserted card is authorized, a counter N is set to zero in step 168, and the franking machine automatically enters the appropriate PIN code, name and/or password in step 169 and a user identification takes place in step 162. If a correct match occurs, data exchange is then permitted to take place in step 126, with the manual entry of data via step 167. A check is repeatedly made in step 127 as to whether the data exchange has ended. If not, further data is permitted to be manually entered via step 167.

If the user identification comparison which took place in step 162 is unsuccessful, the counter N is incremented by one in step 170, and a check is made in step 171 as to whether more than three attempts at user identification have been made. If not, the sequence returns to step 169 and another attempt at user identification is made. If more than three tries still result in an unsuccessful user identification, this fact is registered in step 172 and the word "error" is displayed in step 173 and an instruction to "output card A" is displayed in step 128. The same display occurs when it is determined in step 127 that the data exchange has ended.

Thereafter, in step 129 the instruction "input card B" is displayed, and a similar sequence of steps is undertaken with regard to card B (possibly without the time-out of a time window) as were undertaken with regard to card A. This sequence takes place in steps 130 through 144.

In a further exemplary embodiment, auxiliary functions and/or auxiliary information can be loaded into the postage meter machine with a data carrier 13, preferably with a User chip card ICCBj. Standard jobs are often carried out; for example, only standard letters are to be franked, so that one or more extensive data contents need not be reloaded. No chip card ICCA is then plugged in within the time window 123.

A part of the aforementioned, first data contents a4 through a14 can—as shown in FIG. 6—likewise be stored in table form in the user chip card ICCBj, these being automatically entered into the memory 3 of the postage meter machine after steps 138 (counter reset N=0) under predetermined conditions with step 139 (automatic input of PIN code, name and/or password by postage meter) and step 132 (user identification=YES), and step 134 (data exchange) or if user identification=NO, then branch to step 140 (counter is incremented N=N+1), then proceed to step 141 and if N<3, return to step 139 and if N>3, go to registration step 142, error display step 143 and stop at step 144. A manual input of PRN code or password can thereby be required as an additional condition with step 137 after step 135, if the data input is not yet completed.

The entry of the country, the date and a defined identification number are required as a further condition for a transmission of tabular data from the data carrier 13 for loading functions F1 . . . Fn that are country-associated and are made temporarily available or for loading auxiliary information such as, for example, time tables, hours of business, etc.

The type of functions is selected in the table regions identified as "field" with an identification number that can be input. The functions are available after the loading of the associated data.

In a preferred version of the invention, the password can change on a daily basis, so that individual functions or auxiliary information can be temporarily rented to the patrons in this way in exchange for a payment to be made in advance. The machine takes only those tables from the memory to which a correctly entered password is allocated. A large number of invalid passwords as of the respective date prevents a targeted search for the correct password by unauthorized users. Beginning with a certain number of attempts, unsuccessful attempts automatically lead to the inhibit of the loading of auxiliary information or functions. It is likewise possible that some passwords are openly accessible for learning new functions and remain valid for a certain time span.

One advantageous possibility is the loading of a keyboard key allocation that is adapted to the individual countries. This is easily possible particularly when soft keys are used, since a function designation shown in a display can be easily allocated to these types of keys.

Under the condition that the dispatching country for which the postage meter machine is legal and the advertising designs that are allocated to the cost allocation account are permanently prescribed and stored in the postage meter machine, only the entry of the user name is still required in order to obtain an access authorization for a specific cost allocation account, and thus for the allocated advertising design as well. Such an auxiliary function can be additionally stored in the chip card 10 as a temporary auxiliary function. The authorization for the print-out of all cost-center-related accounting data is another temporary, auxiliary function, whereby no switch-over into a service mode need ensue, and only a name still has to be entered, particularly since the date is automatically prescribed by the postage meter machine. A further advantageous possibility is the selection with step 137—via a name and/or password input—of different forms of cost-allocation-account-related accounting reports to be produced with the printer of the postage meter machine.

One alternative to the franking function is an additional optional printing function, for example printing a received stamp, on the basis of a name and/or password input.

Preferably, the postage meter machine is multiply utilized: received stamp function, accounting reports about the use of the postage meter machine per cost allocation account, calling cards and printing advertising designs. One type font, or type of advert mark presentation is thereby selected in country-associated fashion and is co-transmitted when the password valid at the time is entered.

The chip card 10 thus contains more data than are usually required. At least two conditions must be satisfied (name and country, name and date or country and date) for fetching these data. Auxiliary functions, special functions, or further data can be used with the assistance of temporarily valid passwords that are communicated to the user upon request when payment is guaranteed. By changing the chip card, the auxiliary functions can be updated or data can be updated, without having to modify the programs in the postage meter machine.

With an introduced or a differently colored inking ribbon, the postage meter machine can also be advantageously employed for reducing other printing formats that do not serve the purpose of franking.

ETR and other thermal transfer printing methods have been widespread in the marketplace for a long time as qualitatively high-grade, non-impact printing methods for the greatest variety of applications. The inking ribbons thereby employed enable printing on normal paper, for example in order to print a cost allocation account accounting report or in order to print addresses, received mail stamps, company logos or bar codes on letter envelopes or self-adhesive franking tapes (labels).

The inking ribbon costs and operating costs are dependent on the type and number of uses. The cost allocation account number in the last chip card to be plugged is thus the respective accounting basis for the consumption of inking ribbon and/or labels.

The entry of an identification code on the part of the user is not a precondition for reading such data from the chip card. The user is already authorized to have his advertising design automatically selected. One-hundred such software measures have been undertaken in the postage meter machine on the basis of the program means, these allowing the access of the user to the data that relate to his or her cost allocation account and simultaneously suppressing access of the user to the data that relate to other cost allocation accounts.

The programming tape 101 need not be a program that is stored in the non-volatile memory of the memory 3 for communication via the chip card reader with the chip card, but can instead be formed by a software unit as the programming stage 101 in another embodiment. This embodiment includes an addressable table having at least one password in order automatically to undertake a data exchange between a protected card memory area and the elsewhere present non-volatile memory of the memory means 3 serially within the framework of a communication protocol as soon as the chip card 10 has been inserted into the plug-in slot 26. For example, the card may allow three attempts to enter a password. Differing from the manual input of a password, one can assume freedom from error for the automatic entry of passwords stored in the table with the steps 169 and/or 139. Manual entry attempts are thus unnecessary (see steps 171 or 141) and a maximum of three passwords in programming stage 101) that can be allocated to the various user groups are possible. The three user groups form the set of users.

The postage meter machine program then in step 162 and/or step 132 determines the user group to which the owner of the plugged-in chip card belongs and enables corresponding functions (for data exchange step 126 and/or 134), or inhibits functions for unauthorized users. The postage meter machine is inhibited when a chip card that does not belong to the set of users is inserted.

FIG. 4 shows a corresponding flowchart. After the start and the usual initialization routine of the postage meter machine, the chip card information is first interrogated—as shown in FIGS. 2 or 3—before the system management routine begins.

After the turn-on and the initialization, the configuring chip card Ai can still be inserted into the plug-in slot 23 within a time window. When, however, the end of this chronological duration is reached without a configuring chip card Ai having been inserted, the old configuration of the postage meter machine remains set and the request "INPUT CARD B" ensues in the display.

As long as no chip card was plugged-in, work cannot be carried out with the postage meter machine, i.e. the insertion motor for a sheet of paper, a letter or the like does not start.

Data are read from the chip card after a suitable card has been plugged-in. The identification of a valid card, the selection of a cost allocation account and the setting of the functions ensues, controlled by programming stages 100 and 101.

Figure 5:
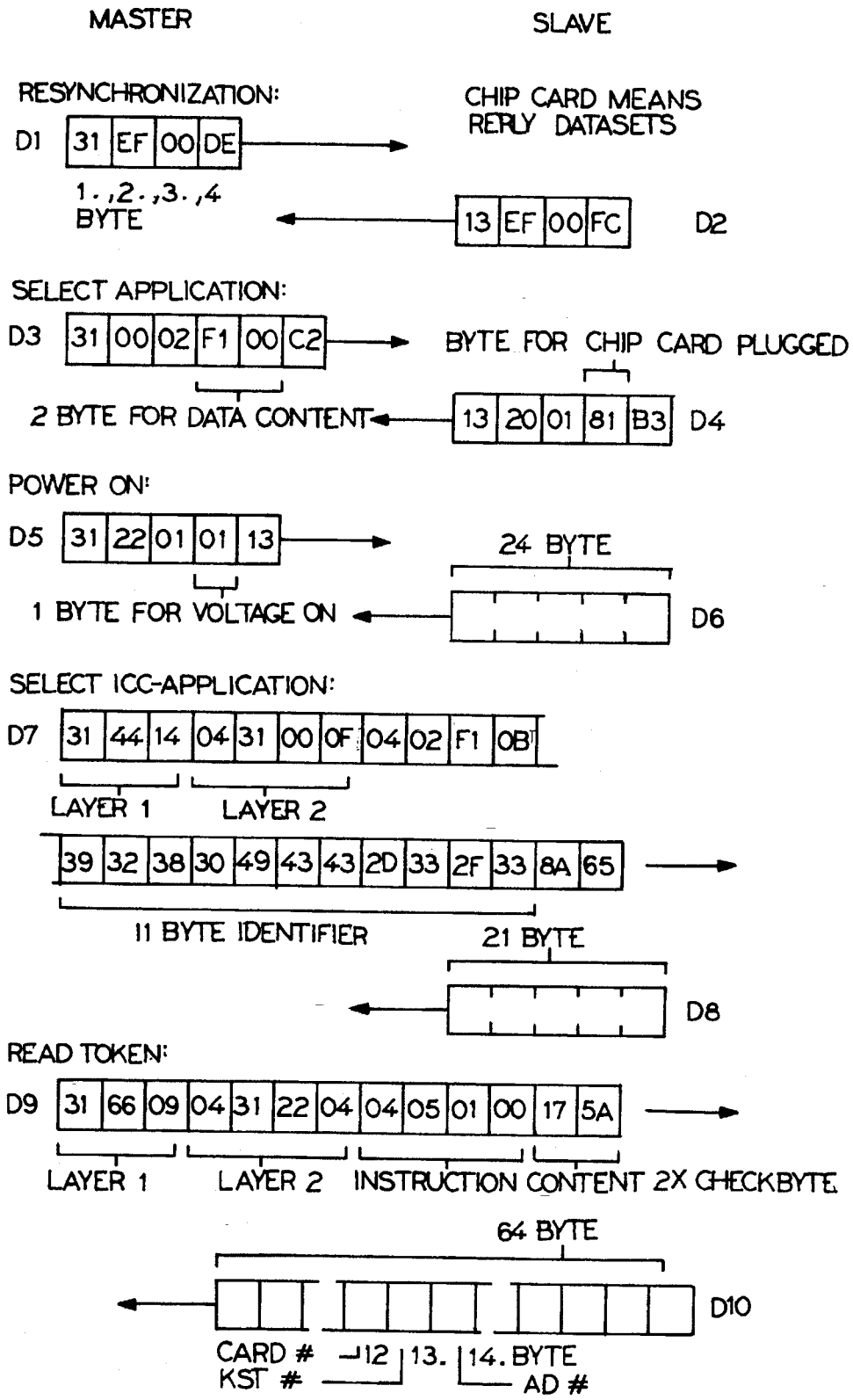
FIG. 5 is a schematic representation of the communication protocol which is used in the machine of FIG. 1.

On the basis of the programming stages 100 and 101, a command sequence is called that begins with the commands RESYNCHRONIZATION, SELECT APPLICATION, POWER ON, SELECT ICC-APPLICATION shown in FIG. 5 and that comprises further commands, including commands for switching into the protected mode of the chip card and for entering passwords. Only after completion of this routine can the data be fetched in order to automatically undertake the setting of the user cost allocation account and the associated, further, aforementioned functions.

When there are no errors, the display "INPUT CARD B" disappears and the corresponding numbers of the cost allocation account and of the functions are displayed.

The programming stages 100 and 101 are thus provided in order to form a command sequence D1, D3, D5, D7, D9, etc., on the part of the postage meter machine and in order to automatically fetch the command sequence D2, D4, D6, D8, etc., from the chip card and the data supplied by it for setting the user cost allocation account and the associated, further functions.

FIG. 4 shows the further course of the operation of the postage meter machine after the data entry has ensued. Proceeding from the system management routine 200, a test mode 202 for testing the individual postage meter machine functions can be set in addition to the operating mode 201. After entry into the operating mode 201, the data editing mode 205 is otherwise reached via the input mode 203. The franking stamp image data that are non-volatilely stored in compressed form, are expanded for generating the fixed pixel image data and are intermediately stored in a volatile main memory of the memory unit 3, which is also referred to as the pixel memory. Variable pixel image data are generated from the non-volatilely stored input data (postage value of the most recent input or current, weight-dependent, input postage value and the date which has been set) and are transferred into the pixel memory wherein this data are combined with the stored in the pixel memory.

If a specified time duration is exceeded or non-readiness exists as determined by a check routine 206, a display mode 207 is initiated. The display mode 207 can likewise be activated via a statistic mode 204 and error evaluation mode 209 to generate messages in order to display errors indicating a statistically unusual entry and to indicate possible alternative operating steps for the postage meter machine, including the reloading of credit.

A print routine 208 is now possible with the data and the date that have been set, whereby the impression ensues as though the print function had been set via the keyboard. The cost allocation account functions are likewise implemented as though they have been set via the keyboard. The keys hitherto provided for the setting have no function. Among other things, thus, an erroneous or intentionally false setting of someone else's cost allocation center is also prevented.

As shown in FIG. 4 the postage meter machine thereafter proceeds via the system management routine into its normal operating mode.

The print controller unit 14 can be equipped with means in one version for electronic orthogonal pixel memory field rotation in order to carry out an internal cost allocation account print-out according to a specific format.

Further details with respect to the printer controller 14 may be derived from German OS 42 24 955.

Figure 7:
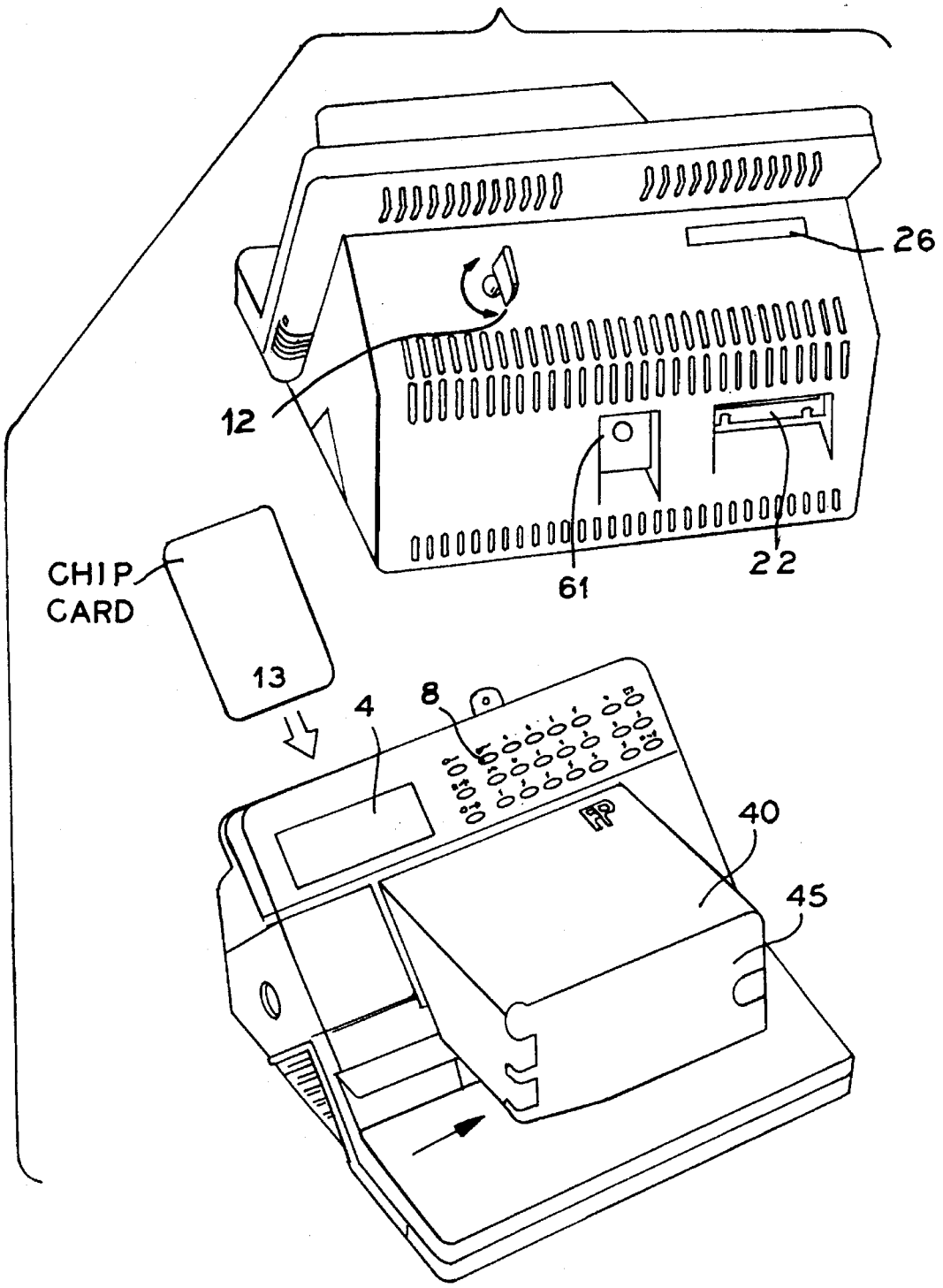
FIG. 7 is a perspective, exploded view showing a mechanical embodiment of the postage meter machine of FIG. 1.

FIG. 7 shows a view of a postage meter machine constructed and operating in accordance with the invention. At its front side, the postage meter machine has a compartment 40 for the inking ribbon cassette and the electronic printer, which is provided with a cover 45, The machine also includes in input unit 8 in the form of a keyboard as well as an output unit 4 in the form of an LCD. An operator key 12, a line connection (I/O unit 81) and a terminal (I/O unit 22) for a further input means, particularly a scale, are arranged at the back side of the postage meter machine.

An I/O unit 20 in the form of a chip card write/read unit having an interface motherboard 24 and a contacting device 25 (see FIG. 9) are built into the postage meter machine such that an opening for the plug-in slot 26 of the contacting device 25 that is easily accessible to the user is located at the back side of the postage meter machine above the terminal (I/O unit 22) for the serial interface of the scale. Good accessibility is achieved on the basis of the position of the opening in the upper third at the back side of the postage meter machine vis-a-vis the LCD (output unit 4). Special visual monitoring when plugging the chip card 13 in is not required since the chip card 13 is introduced from above and is located at the same level as the LCD display when being plugged in.

FIG. 8 shows a flowchart, similar to that of FIG. 4, when a user chip card ICCB is to be employed. After the start and the usual initialization routine of the postage meter machine, the chip card information is again first interrogated (steps 120, 121, 130, 131', 132' and 150) before the system management routine begins (step 200). The authorization in step 131' is then checked in step 132'. When an unauthorized chip card is plugged in, a return is always undertaken back to step 131'.

The fundamental structure of an automatic postage meter machine that contains the arrangement of the invention shall be set forth with reference to a block circuit diagram in FIG. 9.

In a common housing 1, input and output unit 4 and 8 are connected via an I/O board 61 of input/output control unit 6 to a processor system 111 that comprises a mail-oriented security area. This connection can be made directly or via a bus to which at least one memory 3 and a processing unit (CPU) 5 as well as a time/date module 9 are connected. The postage meter machine also includes a printer module 7 and power electronics 11*a* that contains an energy supply and control for the drives (paper transport, printer, ribbon, tape output). The printer module 7 and the power electronics 11*a* are connected to the input/output control unit 6 via respective serial interfaces 66 and 65. Further peripheral input/output units (not shown in greater detail) can be connected to the processor system 111. These are coupled to the processor system 111 directly and/or via the input/output control unit 6.

The memory 3 is composed in a standard manner of a plurality of read-only memories, temporary memories and of non-volatile memories. Together with the CPU 5, a portion of the memories forms a protected postage area within the processor system 111 in a known way. A read-only memory of the memory 3 of the postage meter machine contains programs for communication with the I/O unit 20. Moreover, the programs for a user and addressable tables having addressable data are also stored in the read-only memory of the postage meter machine, whereby each table can be fetched allocated to a specific function. These programs are entered into a programming stage software 100, such as a software stage, that, after the plug-in of a chip card 10 (or 13, as in FIG. 1) into an opening in the postage meter machine provided for that purpose, automatically undertakes the setting of the user cost allocation account and of the appropriate advertising design, and also prevent the call-in of outside cost allocation account data.

The input unit 8 comprising a keyboard and the output unit 4 containing a LCD are connected, as noted above, to an input/output control unit 6, which includes the I/O board 61. which in turn includes an LCD controller and a parallel interface. The output unit 4 serves the purpose of the display of a user entry and the input unit 8 serves the purpose of the selection of the functions and/or of setting the parameters that are required for the implementation of a franking.

As noted above, the postage meter machine is equipped with at least one further, I/O unit 20 (such as a chip card and write/read unit) and the printer module 7 forms a further output unit of the postage meter machine. In I/O unit 20 and the printer module 7 are respectively connected to the input/output control means 6 via serial interfaces 64 and 66.

The port outputs of the microprocessor CPU 5 of the processor system 111 are coupled to the corresponding, serial interfaces (not shown) of the input/output control unit 6 via a demultiplexer (not shown) that is contained in the input/output control means 6 and which includes appropriate gate circuits.

In a further modification (not shown in FIG. 9), some port outputs of the microprocessor CPU 5 of the processor system 111 are coupled to a bus, or directly to the corresponding input or output unit.

In addition to a terminal (I/O unit 22) for an external scale arranged in a known way at the back side of the housing of the postage meter machine, a modem terminal (I/O unit 23) for an external modem can be coupled to the input/output control unit 6 via respective serial interfaces 62 and 63. Further terminals (not shown in FIG. 9) for input means can be provided, which would be respectively coupled to a terminal at an appropriate serial interface of the input/output control unit 6.

In one version having an internal modem (not shown in FIG. 9), a communication terminal to the telephone network is provided next to the terminal for the external scale. A function key of the keyboard (I/O unit 8) can be employed as a modem function key.

Figure 9:
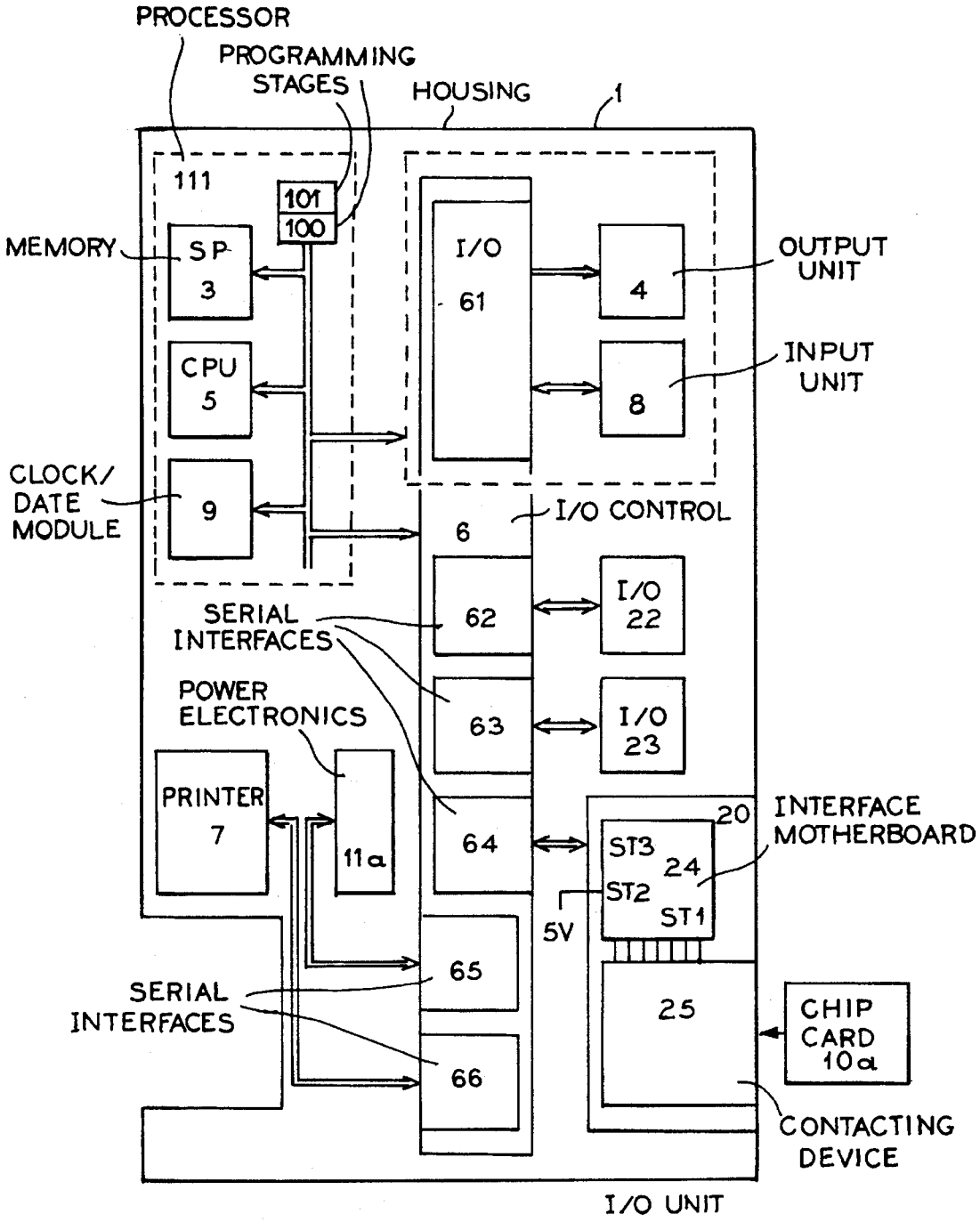
FIG. 9 is a block diagram of a further embodiment of a postage meter machine constructed in accordance with the principles of the present invention.

In FIG. 9, a contacting device 25 is connected via a first terminal ST1 to an interface motherboard 24 of the chip card write/read unit forming I/O unit 20. A second terminal ST2 of the interface motherboard 24 is coupled to the power supply circuit of the postage meter machine and a third terminal ST3 is coupled to the serial interface 64.

For example, a unit known as a CARD READER ENHANCED ADAPTOR MODULE (CREAM) of the ORGA Company can be utilized as chip card write/read unit forming the I/O unit 20.

This known CREAM includes the interface motherboard 24 and the contacting device 25 adapted for ISO chip cards according to the push-pull principle. The manufacturer of the contacting device is Amphenol-Tuchel Electronics GmbH located in Heilbronn, Germany. The same manufacturer distributes the interface motherboard 24. The interface motherboard 24 has its own processor (80C31) and memory in order to be able to execute standard software for all chip cards in common use. The access onto the interface is implemented via a serial, standard interface (V0.24 having TTL level) that is connected to the serial interface of the postage meter machine at ST3. The interface motherboard 24 is connected to the 5 V at ST2 voltage supply and to a V24 driver of the postage meter machine. The V24 driver comprises a level converter from +5 V to ±12 V in the postage meter machine.

The contacting device 25 of the chip card write/read unit forming the I/O unit 20 is equipped with eight electrical contacts defined in the ISO standard (ISO 7816) and enables more frequent change of cards for a plurality of further users.

The introduced chip card 10 and 13 contains a corresponding set of contacts numbering eight contacts, a processor and a memory. The communication and operating system of the card enables the implementation of communication protocols and the DES algorithm. Access onto the memory of the card is controlled with the communication protocol.

The operating system of the postage meter machine is thus capable of gaining access to the memory of the chip card and to read and to write its contents. The programming stage 100, which may be a software stage contained in the postage meter machine undertakes an appropriate signaling or message in the output unit 4 (LCD) when a chip card is not inserted and inhibits franking with the postage meter machine until the chip card 10 and 13 for setting the user cost allocation account and the associated advertising design is plugged-in.

The following, simplified function sequence is implemented for the user of the postage meter machine.

After switching the postage meter machine on, the display "Card" appears in the display and thus prompts the user to insert a chip card. As long as no chip card is plugged, franking cannot be carried out with the postage meter machine, i.e. the insertion motor for a letter does not start.

After the insertion of a suitable card, data are read from the chip card. The identification of a valid card, the selection of a cost allocation account, and the setting of an advertising design thus ensue. When there are no errors, the display "Card" disappears and the corresponding numbers of the cost allocation account and of the advertising design are displayed.

A franking is now possible with the data that have been set, i.e. the postage value and the date, whereby the impression of the advertising design ensues as though it had been set via the keyboard. The cost allocation account functions are likewise implemented as though they had been set via the keyboard.

The keys previously provided for setting the advertising design and the cost allocation account have no function. The erroneous or intentionally false setting of someone else's cost allocation account is thus prevented. A user not legitimized by the possession of a chip card no longer has any possibility of fetching the data of someone else's cost allocation accounts in response to pressing a button.

The particular key, which was hitherto utilized for changing the cost allocation account, is thus free for other functions, for example for a modem for automatic remote valuation of a credit. As an alternative for the modem, the credit reloading known as surface "telepostage" also continues to be freely available in a known way.

The transfer shown in FIG. 5 between the operating system of the postage meter machine and the chip card interface ensues according to a master/slave principle. As master, the postage meter machine generates commands and receives replies from the chip card interface as the slave. The dialogue routine is constantly implemented in the background. It is composed of five commands.

First, a resynchronization is implemented. The postage meter machine sends a first data set D1 containing four bytes. As a result, the chip card is placed into a defined condition. This data set D1 contains an address in the first byte, one byte (check byte) for a check word with counter reading for each protocol unit (PDU), and one byte for the data length. The data length initially amounts to the length 00. The check byte serves the purpose of error protection of the transmission.

The reply of the chip card means is a data set D2 containing four bytes, having the mirrored address in the first byte, the check byte, and the byte for the data length.

After the reception of a positive reply, the transmission of a select application sequence with a third data set D3 ensues from the master, having the address in the first byte, the counter reading which has been incremented in the meantime, or the check byte, and the byte for the data length. The data length 02 indicates that two bytes of data content follow. The first byte thereof is the instruction code SELECT APPLICATION. The data content of the second byte is 00. The check byte again forms the termination.

In the error-free case, the chip card unit returns a return code from which it proceeds that the chip card is plugged-in. The data set D4 for the return code again comprises the mirrored address in the first byte. A following check byte is again incremented in the upper nibble (half byte). A third byte for the data length indicates the data length 01 here. A fourth byte thus follows that forms the actual return code for the plugged-in but voltage-less chip card. The check byte again follows as a termination.

With the third command POWER ON, the voltage is connected to the card. The data set D5 has five bytes and thereby has the same structure as the data set D4, with the address in the first byte, the check byte, the byte for the data length, and the fourth byte. The fourth byte contains the information that the voltage is switched on.

As a reply of the chip card unit, the "Answer to Reset" defined according to the T=14 specification is anticipated, this covering a data set D6 having 24 bytes, whereby the last byte is again the check byte.

The fourth command SELECT ICC-APPLICATION contains an identifier of the card manufacturer for the ICC (Integrator Chip Card). The data set D7 contains a plurality of interlaced or nested layers. The first layer comprises the address in the first byte, the check byte, the byte for the data lengths, which is followed by another 20 bytes that begin with a check byte which is followed by an address byte, a check byte, and a byte for the data length in the second layer; a third layer then begins with the check byte and a further byte and has an instruction byte F1 and a byte OB for the data length of another following eleven bytes which contain the aforementioned identifier of the card manufacturer in the form of ASCII-coded data. These eleven bytes stand for the identification 9280 ICC-3/3. Two check bytes form the termination.

A data set D8 which is 21 bytes long and with which an application is selected is anticipated as the reply of the chip card unit.

With the fifth command, READ TOKEN, the chip card is requested to output data from unprotected area. The first and second layers of the data set D9 that is a total of 13 bytes long are constructed analogously to the fourth command, whereby the eighth through eleventh bytes contain the actual instruction for READ TOKEN and two check bytes again reside at the end.

A data set D10 that is 64 bytes long is again anticipated as the reply of the chip card unit, this data set D10 having the mirrored address in the first byte, the check byte, the byte for the data length, etc., and the check byte at the end. The twelfth byte thereby contains the data for the chip card number (card #), the thirteenth byte contains the data for the cost allocation account number (KST #), and the fourteenth byte contains the data for the advert mark number (AD #).

The data are read from the chip card with the data set D10 and are written at the corresponding memory location of the postage meter machine. The entry of an identification code on the part of the user is not a condition for reading such data from the chip card. The owner is already authorized to have his or her advertising design automatically selected. Such software measures have been undertaken in the postage meter machine with the programming stage 100 and allow the access of the user to the data that relate to his or her cost allocation account and simultaneously suppress the access of the user to the data that relate to the other cost allocation accounts. The programming stage 101 may contain memory locations of the postage meter machine operating system.

In a further version that is not shown, the unprotected memory area of the chip card is first interrogated after a chip card 13 has been plugged into an opening of the postage meter machine provided for that purpose, and the data are then transferred from the unprotected memory area into the memory of the postage meter machine. The data can modify the function of the postage meter machine and/or reload a current postage fee table, as has already been set forth. Data are stored in addressable tables, whereby each table has a specific function fetchably allocated to it and can be transferred into the memory of the postage meter machine. 2 through 7K bytes are available for this purpose in the protected memory area of the chip card, whereas only 32 bytes can be fetched in the unprotected memory area of the chip card.

Figures 10, 11:
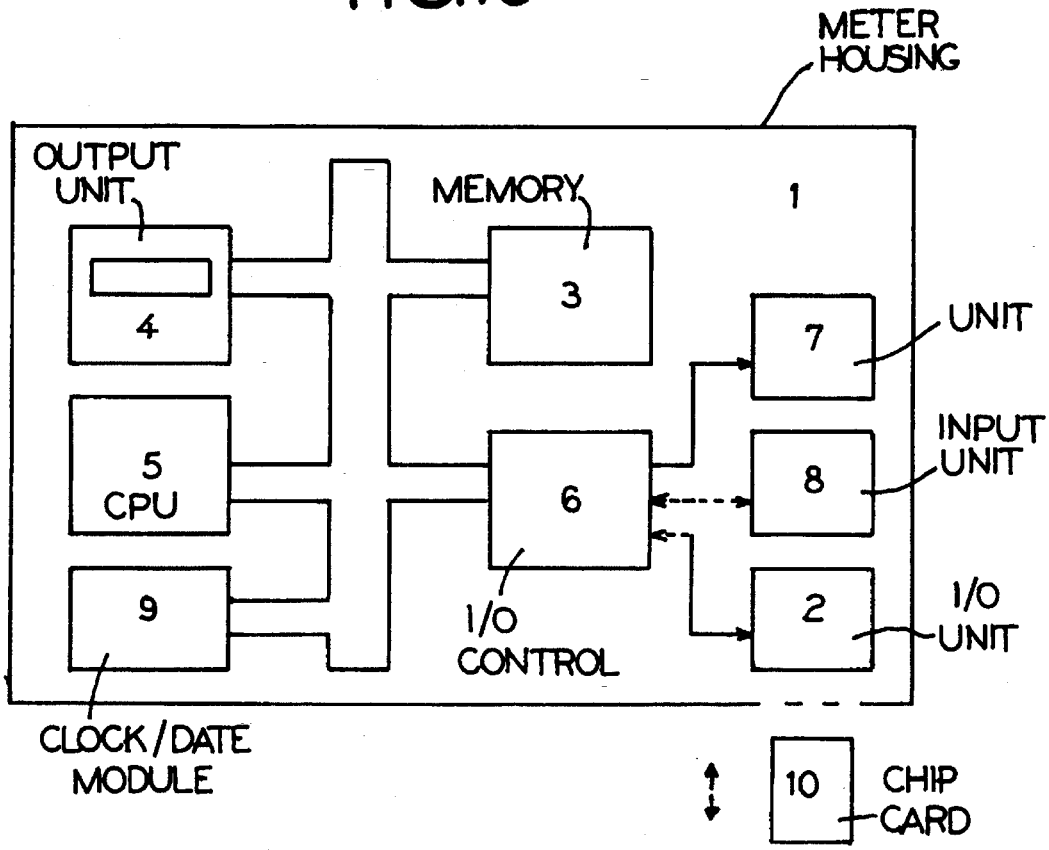
FIG. 10 is a simplified block diagram of a postage meter machine constructed in accordance with be principles of the present invention.
FIG. 11 shows the arrangement of postage fee table memory areas in the postage meter machine of the invention.

In particular, a chip card 10*e* carrying a current postage fee table and an additional postage fee table valid for the future rates is utilized as the data carrier, as already known for prescribing the values of fee values. FIG. 10 shows a simplified block circuit diagram of the postage meter housing 1 containing a chip card I/O (write/read unit 2. A memory 3 is in communication with an output unit 4, such as display and is in communication via a bus with a control module 5, as well as with an input/output control unit 6 to which a printer module 7, an input unit 8 and the chip card I/O unit 2 are connected. Further—not shown in greater detail in FIG. 1—, a terminal for a scale module is provided directly via the bus or via the input/output control unit 6. Further, the presence of a programmable, battery-supported clock module 9 in every postage meter machine is assumed, the accuracy and programming thereof being such that the correct date data are produced in order to load the memory 3 of the postage meter machine with the current date data and the future, specific date data for when postage fee tables allocated thereto take effect. The programming is particularly directed to the locally different time to be taken into consideration, the time zones of the earth essentially dependent on the degree of longitude or the date limit to be taken into consideration.

This is advantageous for a postage meter arrangement which is to be only stationarily operated (i.e., non-mobile) and is also particularly advantageous for a portable postage meter machine that can be carried from place to place, because a one-time setting of the clock at the factory can suffice and the local time can be set via the entry of the location. To this end, a memory area is provided for the clock module 9 that contains the relevant locations with the associated shift of local time for setting the clock. The local time shift is added to Greenwich time.

The control module 5 of the postage meter machine, upon initialization of the postage meter machine 1, loads at least one postage fee table for the postage meter machine from the chip card 10*a* via the I/O unit 2 and the input/output control unit 6 in a predetermined memory space of the memory 3. The control module 5 selects the current postage fee cable in force via on the basis of the dispatching country or location that has been entered and on the basis of the date, the respective postage fee being calculated with reference thereto. The circuitry in the control module 5 for accomplishing these functions can be fabricated as a programmed or a freely programmable logic module, or hard-wired as a program of a microprocessor controller programmed by hardware and/or software.

The chip card 10*a* is provided for use as a debit card with a national or international validity; this, however, is not intended to exclude other accounting methods for monetary data. It is preferably executed for use in the European Community. For example, a service center for the National Postage Authorities assumes the payment and debiting of the fees.

Further functions can be stored in the chip card 10*a* fetchable by the current date supplied by the clock module 9. The information for the further functions to be loaded into the postage meter machine is thereby linked to a condition (date, time, location).

In particular, the protection against fraudulent manipulations can be enhanced in that a plurality of functions allocated to the updating date can be loaded into the postage meter machine during updating and the further functions to be triggerably loaded are many and are not selectively offered. For protection against fraudulent manipulations, a printout that can be machine-read only by the respective National Postal Authority can be prescribed by the National Postal Authority to which the respective dispatching location belongs. This printout, for example, can be the transaction number for an authorization check in bar code presentation or some other declared character which is printed at a defined location on the postal matter upon employment of the same or of another printer.

Moreover, the input possibility for the dispatching location, location of the mailbox or of the applicable post office and/or of the respective postal authority can be provided by the input unit 8 in order, among other reasons, to make a further selection among the functions loaded into the postage meter machine.

FIG. 11 shows a memory area having a memory section allocated to an updating date for the current and for the future postal fee table. Dependent on the memory area allocated to a dispatching country, at least one postage fee table is thus on hand. This enables the correct setting of the fees for every machine on the basis of the information stored in the transmission means. Every postage fee table valid for a National Postal Authority is divided into zones for mailing postal matter from the dispatching location, i.e. the post office, to which the mailbox to be loaded with franked postal matter is allocated. The zones allocated to the distances and/or a designation of a zone as domestic or foreign, or the distance from the dispatching location to the receiving location can, as an auxiliary function, be fetchably stored for every country in a further memory area A, B, C . . . (not shown) and the corresponding zone of the current table is addressed by the control means. After the calculation of the correct zone, the postal patron can make a selection among the type of mailing (letter, reply postcard, printed matter, printed matter letter, package, etc.) agreed upon by the manufacturer of the postage meter machine and the respective national post offices, the form of mailing (indication of value, registered, hand-delivery, delivery, return receipt, C.O.D., special delivery, air mail, rapid delivery, poste restante, etc.), and additional performances (preferential availability) or similar prints (advert mark advertising, etc.). After the entry of a weight amount and of the type of mailing and of the form of mailing of the postal matter, the postage fee corresponding to the zones can be automatically taken. Further postal fee tables (not shown in FIG. 11 ) valid in future from the current, further updating date for further (preferably for each) national postal authorities are stored in memory areas. The date to be entered for the date stamp appearing on the postal matter is to be compared by the control means to the updating date for when the table takes effect for each of the tables.

FIGS. 12 and 13 show the auxiliary function tables that are stored in further memory areas and are respectively allocated to a dispatching country AB or to a location and/or to a daily date. By entering the dispatching country A, B for every area, a first selection is manually or automatically made among the functions to be loaded into the postage meter machine, and these are loaded into the memory means of the postage meter machine when it is initialized. The auxiliary functions F1 (payment for special deliverers from 6:00 A.M. until 10:00 P.M.), F2 (payment for special deliveries from 10:00 P.M. through 6:00 A.M.), F3 (payment for independent delivery), through Fn among other things, are valid for a declared time of day, or a limited time span determined by the respective national postal authority (FIG. 12).

FIG. 6 shows a table for a plurality of auxiliary functions to be transmitted into the postage meter machine that are freely selectable thereafter. In the normal case, the mail is picked up given stationary operation of a postage meter machine. Erecting an in-house, stationary mailbox can also be agreed upon with the post office. For mobile employment of a postage meter machine, it is necessary to use further service performances of the postal authorities (allocation of postal zip code and numbers of post offices to place names). The data for constantly open mailboxes serving as acceptances for postal matter at public places, harbors, airports, railroad stations, traffic stations, among other things, system centers listed in another updatable list (not shown) are suitable for fetching stored information or for making functions available after these data for open receiving locations and the date have been manually entered in a field. A further memory area is provided for this purpose. When, due to location, a number of functions cannot be selected, then another dispatching location that enables these functions can be identified.

Printing specific auxiliary information at a different location on the postal matter, particularly calendrical information and temporary advertising messages, can also be agreed upon between the patron and the manufacturer. For example, a sponsor of a trade show can thus advertise. These types of information to be printed automatically appear in the printing format according to the prior programming. A further memory area can also be provided for this purpose.

FIG. 13 shows a table for the permanently declared auxiliary functions to be transmitted onto the postage meter machine on the basis of a condition. For example, the auxiliary functions effecting an additional identification serve for the reliability of recognizing a pre-dating for future mail, i.e. mail that is franked in advance. Such functions are agreed upon by the manufacturer of the postage meter machine and the postal authority and are defined by the point in time of the delivery of the mail at the dispatching location.

A further selection from functions to be loaded into the postage meter machine is automatically made by entering a field for the dispatching location, location of the mailbox, particularly the postal zip code (PZC) or a field for the number of the responsible post office. This selection is loaded into the memory means of the postage meter machine when it is initialized (FIG. 6 or FIG. 13).

Figures 14, 15:
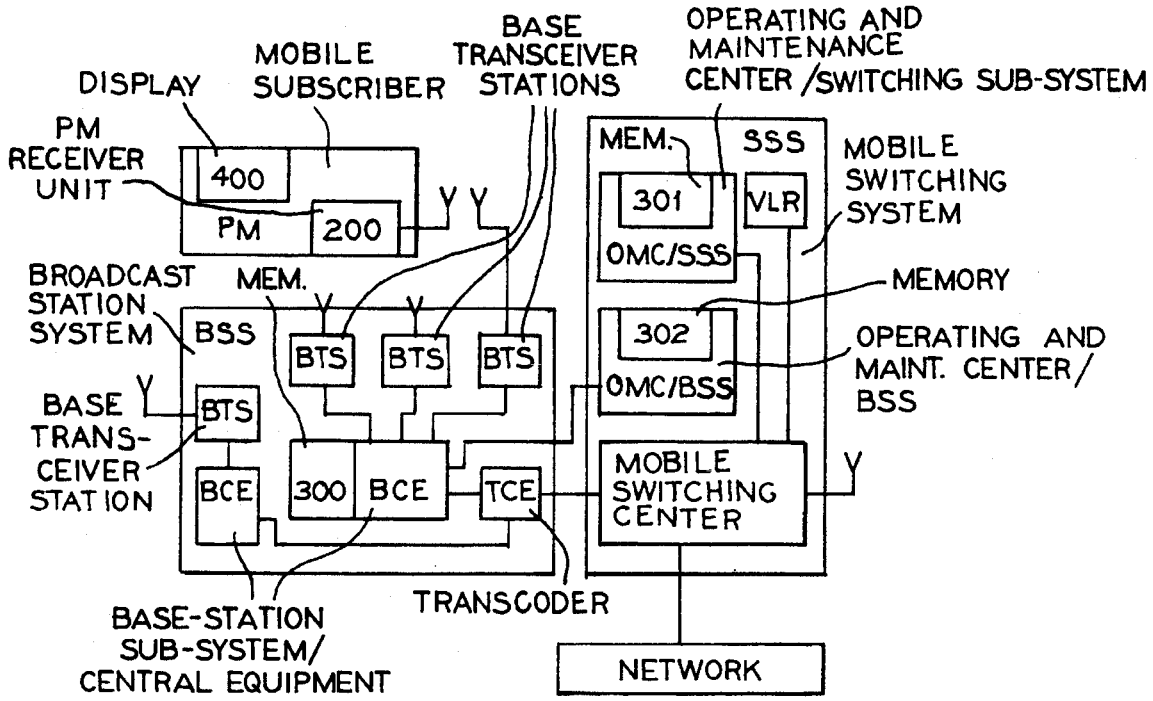
FIG. 14 is a block diagram of a mobile communication version of a postage meter machine constructed in accordance with the principles of the present invention.
FIG. 15 shows the arrangement of the information field in the postage meter machine of the invention.

In a further version of the invention shown in FIG. 14, cellular communication networks, particularly Group Special Mobile Networks (GSM networks) are utilized as the data carrier. Such GSM networks comprise a mobile switching system (SSS) having interfaces, to other cellular radio networks or fixed networks NETZ, particularly (PSTN, ISDN, PDN), as well as to the mobile subscribers PM (at which a postage meter machine constructed and operating in accordance with the invention having a receiver unit 230 and a display 400 can be located) via a fixed broadcast station system BSS. A transcoder unit TCE is connected in the BSS to a plurality of BSS central units BCE to which the respective transmission/reception stations BTS are connected which exchange information with a postage meter receiver unit 230. The operating and maintenance center OMC/SSS of the mobile broadcast system and the operating and maintenance center OMC/BSS of the fixed broadcast station system BSS the broadcast station central equipment BCE are equipped with respective memories 300, 301 and 302 which constitute memory sections for the fetchable, published postage fee tables and non-secret auxiliary function tables and for further service and auxiliary information.

The entry of the dispatching country or location and of the national or local time can preferably automatically ensue for portable postage meter machines given an established mobile broadcast network (D-network).

An information field shown in FIG. 15 for date, dispatching location, weight, format, postage fee and further standard particulars, as well as for the auxiliary functions allowed by the respective national postage authority can be displayed in the display 400 of the postage meter machine 100 in order to undertake a selection of the functions. The information such as device number, transaction number, piece payment, registration amount, postage sum, accounting list that can only be fetched with a password are thereby not displayed.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for operating a postage meter machine comprising the steps of:

storing data relating to the operation of a postage meter machine in a data source separate from said postage meter machine;

storing programs, which use operating data for operating said postage meter machine including performing franking, in a program memory in said postage meter machine;

storing said operating data in a data memory in said postage meter machine;

turning on said postage meter machine for operation thereof;

providing a single means in said postage meter machine for reading data from said data source; and loading data into said postage meter machine, within a time window following turn-on of said postage meter machine and before performing franking, by establishing communication between said data source and said means for reading data, transferring predetermined, selected data from said data source into said data memory, and modifying said operating data with said predetermined, selected data from said data source and thereby generating new operating data stored in said data memory.

2. A method as claimed in claim 1 wherein the step of loading data comprises storing country-associated auxiliary functions and information in said data source, storing user-associated setting information for said postage meter machine in a further source, and establishing communication between said data source and said means for reading data to transfer said country-associated auxiliary functions and information into said data memory, de-establishing communication between said data source and said means for reading, and establishing communication between sale further data source and said means for reading to transfer said user-associated setting information from said further data source into said data memory.

3. A method as claimed in claim 1 wherein the step of establishing communication between said data source and said means for reading data comprises connecting said postage meter machine, via said means for reading data, to a communication network comprising said data source containing a memory in which said data relating to the operation of said postage meter machine are stored.

4. A method as claimed in claim 1 wherein the step of storing said data relating to the operation of said postage meter machine comprises storing said data relating to the operation of said postage meter machine in an integrated chip card removably insertable into said means for reading data in said postage meter machine.

5. An apparatus for franking items comprising:

a postage meter machine;

chip card means, separate from said postage meter machine, for storing data relating to the operation of said postage meter machine;

program memory means, contained in said postage meter machine, for storing operating programs which use operating data for operating said postage meter machine including performing franking;

data memory means, contained in said postage meter machine, for storing said operating data;

means for turning on said postage meter machine for the operation thereof;

single chip card means reader means, contained in said postage meter machine, for reading said data relating to the operation of said postage meter machine from said chip card means;

means for setting a time window following turn-on of said postage meter machine; and control means for controlling loading of data into said postage meter machine, within said time window and before performing franking, by establishing communication between said chip card means and said chip card means reader means, for transferring predetermined, selected data from said chip card means, and for modifying said operating data with said predetermined, selected data from said chip card means and for thereby generating new operating data and for storing said new operating data in said data memory means.

6. An apparatus as claimed in claim 5 further comprising:

means in said postage meter machine for receiving and verifying a password; and wherein said control means comprises means for enabling reading of data from said chip card means by said chip card means reader means only after the entry of at least one valid password into said means for receiving and verifying said password.

7. An apparatus as claimed in claim 6 wherein said chip card means includes an unprotected memory area containing a chip card number, a cost allocation account number and an advert mark number, and wherein said chip card means contains a protected memory area containing protected data, and wherein said control means comprises means for automatically reading the data contained in said unprotected memory area of said chip card means upon insertion of said chip card means in said chip card means reader means, and for enabling transfer of said protected data from said protected memory area of said chip card means into said data memory means only upon the entry of said at least one valid password.

8. An apparatus as claimed in claim 6 further comprising:

means in said postage meter machine for entering a password;

means for enabling transfer of at least a portion of data from said chip card means into said data memory means upon the entry of a valid password; and means for storing a table of valid passwords in said postage meter machine and means for checking the entered password against passwords in said table.

9. An apparatus as claimed in claim 6 further comprising:

said postage meter machine having a housing for said apparatus having a backside with an opening, said chip card means read means having an opening for receiving a chip card means in registry with said opening in said back of said housing;

means for preventing franking in the absence of a chip card means inserted in said opening; and display means for indicating the absence of a chip card means in said opening after said postage meter machine is turned on.

10. An apparatus as claimed in claim 9 wherein said display means is disposed at a front of said housing opposite said opening in the back of said housing, said display means and said opening in the back of said housing being disposed in an upper third of said housing, and said apparatus further comprising a serial interface terminal for a scale disposed below said opening in said back of said housing.

11. An apparatus as claimed in claim 10 wherein said chip card means reader means includes contact means for making contact with a chip card means inserted in said chip card means reader means, and said apparatus further comprising an interface motherboard in said postage meter machine connected between said chip card means reader means and said data memory means, said contact means comprising at least six electrical contacts; and said control means comprising means for automatically serially transferring at least a portion of data contained in said chip card means to said data memory means as soon as said chip card means is inserted into said chip card means reader means.

12. A method for entering data into a postage meter machine having a plurality of selectable printer functions, before initiation of a selected printer function, comprising the steps of:

inserting a first integrated chip card into a chip card reader in said postage meter machine for automatically transferring data from said first integrated chip card into a memory of said postage meter machine within a time window following turn-on of said postage meter machine for modifying a most recently stored setting of said postage meter machine;

displaying data identifying the loading of data from said first integrated chip card;

removing said first integrated chip card from said chip card reader and inserting a second integrated chip card into said chip card reader containing data relating to a user of said postage meter machine and the selected printer function; and initiating said selected printer function contained on said second integrated chip card.

13. A method as claimed in claim 12 wherein said first integrated chip card is one of a plurality of first integrated chip cards respectively containing different data, and wherein the step of inserting said first integrated chip card into said chip card reader is further defined by inserting each of said first integrated chip cards in said plurality of first integrated chip cards successively into said chip card reader for entering all of the data contained in said plurality of first integrated chip cards.

14. A method as claimed in claim 13 wherein said data carried by said plurality of first integrated chip cards includes a plurality of separate data contents, and comprising the additional step of storing one data content respectively on each first integrated chip card in said plurality of first integrated chip cards.

15. A method as claimed in claim 13 wherein said data carried by said plurality of first integrated chip cards comprises a plurality of data contents, and wherein each first integrated chip card carries a combination of different data contents.

16. A method as claimed in claim 12 wherein said second integrated chip card is one of a plurality of second integrated chip cards respectively containing different data, and wherein the step of inserting said second integrated chip card into said chip card reader is further defined by inserting each of said second integrated chip cards in said plurality of second integrated chip cards successively into said chip card reader for entering all of the data contained in said plurality of second integrated chip cards.

17. A method as claimed in claim 16 wherein said data carried by said plurality of second integrated chip cards includes a plurality of separate data contents, and comprising the additional step of storing one data content respectively on each second integrated chip card in said plurality of second integrated chip cards.

18. A method as claimed in claim 16 wherein said data carried by said plurality of second integrated chip cards comprises a plurality of data contents, and wherein each second integrated chip card carries a combination of different data contents.

* * * * *